US011939819B2

(12) United States Patent
Dietz et al.

(10) Patent No.: US 11,939,819 B2
(45) Date of Patent: Mar. 26, 2024

(54) MILL BIT INCLUDING VARYING MATERIAL REMOVAL RATES

(71) Applicant: Halliburton Energy Services, Inc., Houston, TX (US)

(72) Inventors: Wesley P. Dietz, Carrollton, TX (US); David Joe Steele, Carrollton, TX (US); Christopher Grace, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/860,250

(22) Filed: Jul. 8, 2022

(65) Prior Publication Data

US 2023/0008467 A1 Jan. 12, 2023

Related U.S. Application Data

(60) Provisional application No. 63/220,839, filed on Jul. 12, 2021.

(51) Int. Cl.

| | |
|---|---|
| ***E21B 10/43*** | (2006.01) |
| ***E21B 7/06*** | (2006.01) |
| ***E21B 10/26*** | (2006.01) |
| ***E21B 10/567*** | (2006.01) |
| ***E21B 29/06*** | (2006.01) |
| *E21B 41/00* | (2006.01) |

(52) U.S. Cl.

CPC ..... *E21B 10/43* (2013.01); *E21B 7/061* (2013.01); *E21B 10/567* (2013.01); *E21B 29/06* (2013.01); *E21B 10/26* (2013.01); *E21B 41/0035* (2013.01)

(58) Field of Classification Search

CPC ..... E21B 10/26; E21B 10/43; E21B 10/567; E21B 29/06; E21B 41/0035; E21B 7/061

See application file for complete search history.

(56) References Cited

U.S. PATENT DOCUMENTS

| | | | |
|---|---|---|---|
| 1,380,954 A | 6/1921 | Hall | |
| 2,544,982 A | 3/1951 | Buttolph | |
| 4,420,049 A | 12/1983 | Holbert | |
| 5,425,419 A | 6/1995 | Sieber | |

(Continued)

FOREIGN PATENT DOCUMENTS

| | | | |
|---|---|---|---|
| EP | 2723975 B1 | 11/2017 | |
| GB | 2335217 A * | 9/1999 | ..... E21B 10/54 |

(Continued)

*Primary Examiner* — Caroline N Butcher

(74) *Attorney, Agent, or Firm* — Scott Richardson; Parker Justiss, P.C.

(57) ABSTRACT

A mill bit and a well system are covered. The mill bit, in one aspect, includes a tubular having an uphole end and a downhole end. The mill bit, in accordance with this aspect, further includes a first cutting section having one or more first cutting surfaces disposed about the tubular, the first cutting section having a first material removal rate and configured to engage with wellbore casing disposed within a wellbore. The mill bit, in accordance with this disclosure, further includes a second cutting section having one or more second cutting surfaces disposed about the tubular, the second cutting section having a second material removal rate less than the first material removal rate and configured to engage with a whipstock disposed within the wellbore.

46 Claims, 26 Drawing Sheets

(56) References Cited

U.S. PATENT DOCUMENTS

| | | | | |
|---|---|---|---|---|
| 5,499,680 | A | 3/1996 | Walter et al. | |
| 5,816,324 | A | 10/1998 | Swearingen et al. | |
| 5,944,101 | A | 8/1999 | Hearn | |
| 7,353,867 | B2 | 4/2008 | Carter et al. | |
| 7,370,702 | B2 | 5/2008 | Stowe | |
| 7,422,057 | B2 | 9/2008 | Lewis et al. | |
| 7,610,971 | B2 | 11/2009 | Neff | |
| 8,245,774 | B2 | 8/2012 | Carter et al. | |
| 8,307,890 | B2 | 11/2012 | McGarian | |
| 8,453,737 | B2 | 6/2013 | McGlothen et al. | |
| 9,228,406 | B2 | 1/2016 | Swadi et al. | |
| 9,915,098 | B2 | 3/2018 | Alsup et al. | |
| 10,487,606 | B2 | 11/2019 | Swadi et al. | |
| 10,648,266 | B2 | 5/2020 | Su et al. | |
| 11,313,193 | B2 | 4/2022 | McGarian | |
| 2005/0150656 | A1* | 7/2005 | Stowe | E21B 7/061 166/55.3 |
| 2006/0027359 | A1 | 2/2006 | Carter et al. | |
| 2008/0017378 | A1* | 1/2008 | McGlothen | E21B 7/061 166/55.7 |
| 2008/0185148 | A1 | 8/2008 | Carter et al. | |
| 2009/0133877 | A1 | 5/2009 | Neff | |
| 2010/0012322 | A1* | 1/2010 | McGarian | E21B 7/061 166/298 |
| 2011/0308785 | A1 | 12/2011 | McGarian | |
| 2013/0199784 | A1* | 8/2013 | Swadi | E21B 10/43 166/55.7 |
| 2015/0152702 | A1 | 6/2015 | Stowe et al. | |
| 2016/0090805 | A1 | 3/2016 | Swadi et al. | |
| 2016/0237770 | A1 | 8/2016 | Korf | |
| 2018/0094496 | A1* | 4/2018 | Su | E21B 29/06 |
| 2020/0332614 | A1 | 11/2020 | McGarian | |
| 2023/0008467 | A1 | 1/2023 | Dietz et al. | |
| 2023/0015654 | A1 | 1/2023 | Dietz et al. | |

FOREIGN PATENT DOCUMENTS

| | | | |
|---|---|---|---|
| WO | 2005071210 | A1 | 8/2005 |
| WO | 2016099439 | A1 | 6/2016 |

* cited by examiner

200c

300

MILL BIT INCLUDING VARYING MATERIAL REMOVAL RATES

CROSS-REFERENCE TO RELATED APPLICATION

This application claims the benefit of U.S. Provisional Application Ser. No. 63/220,839, filed on Jul. 12, 2021, entitled "STEEL CASING WINDOW MILLING SYSTEM," commonly assigned with this application and incorporated herein by reference in its entirety.

BACKGROUND

A drill bit/mill bit can be used to drill a wellbore in a formation through rotation of the drill bit/mill bit about a longitudinal axis. A drill bit/mill bit generally includes cutting elements (e.g., fixed cutters, milled steel teeth, carbide inserts) on cutting structures (e.g., blades, cones, discs) at a drill end of the drill bit/mill bit. The cutting elements and cutting structures often ride up a whipstock to form an opening in the casing and a wellbore in a subterranean formation.

BRIEF DESCRIPTION

Reference is now made to the following descriptions taken in conjunction with the accompanying drawings, in which.

Figure 5A:
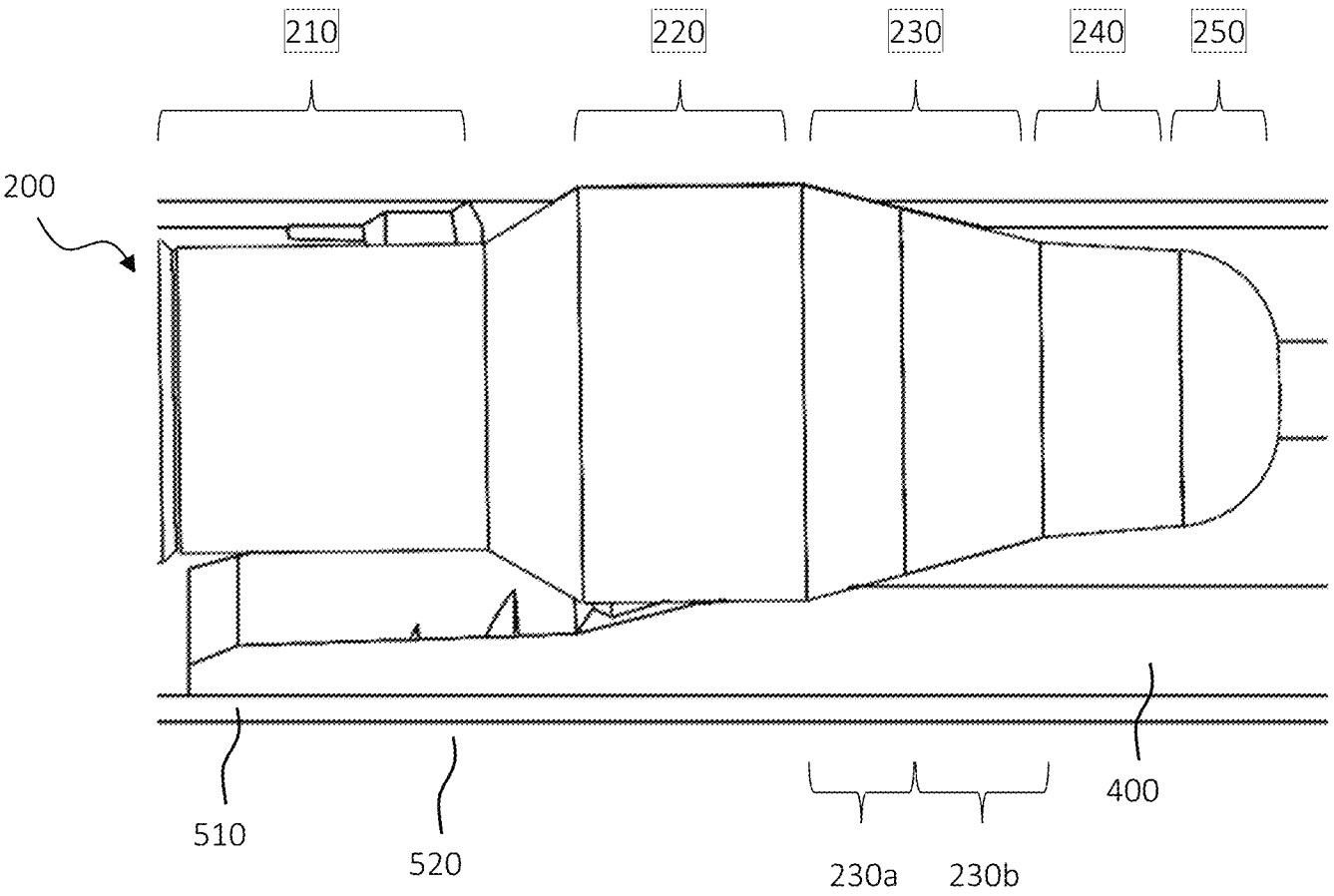
Figure 5B:
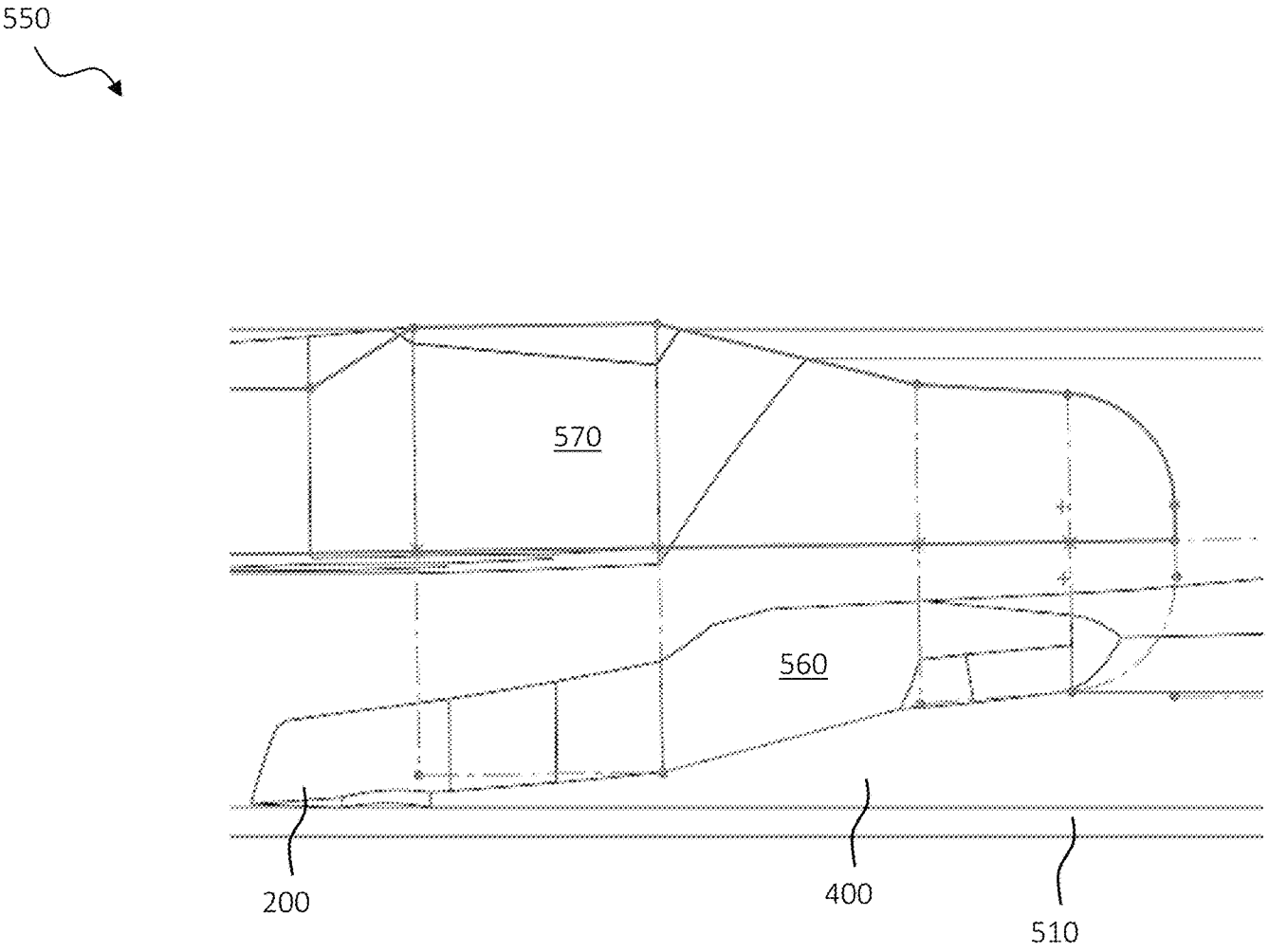
Figure 6:
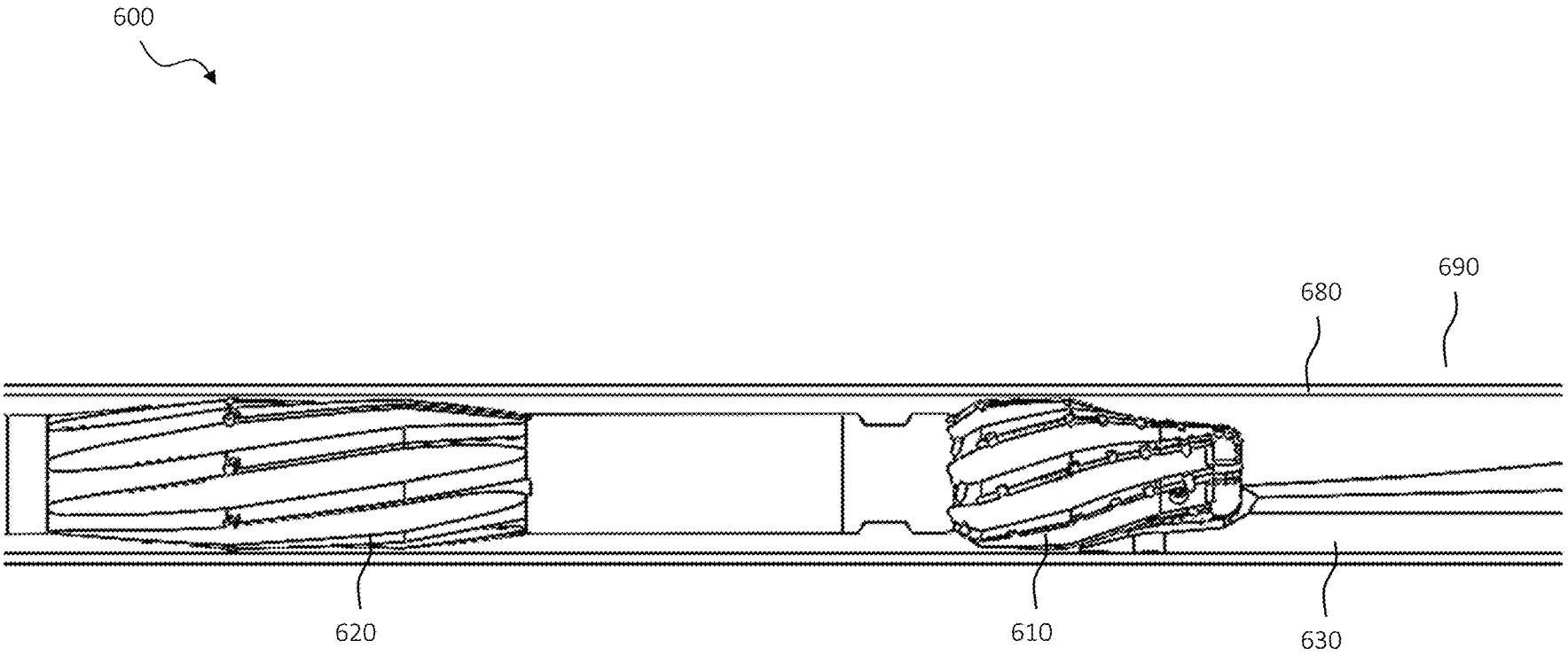

FIGS. 5A and 5B illustrated one embodiment of the interaction between a mill bit designed according to one embodiment of the disclosure and a whipstock designed according to one embodiment of the disclosure;

FIG. 6 illustrated a mill assembly designed, manufactured and/or operated according to one or more embodiments of the disclosure; and FIGS. 7 through 19 illustrate a method for forming, accessing, potentially fracturing, and producing from a well system according to one embodiment of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure is based, at least in part, on the recognition that cutting structures at various locations on the same mill bit are exposed to different loading as they interface with the casing, whipstock and/or formation. Based at least partially on this recognition, the present disclosure, for the first time, has developed a mill bit (e.g., lead mill bit), which in certain embodiments employs a unique design, which consumes less whipstock and more casing material. In at least one embodiment, the mill bit has varying material removal rates in different sections of the mill bit. In at least one other embodiment, the mill bit is designed to effectively mill steel and formation. In at least one other embodiment, the mill bit has different wear rates or life performance in different sections thereof. Further to one embodiment, the mill bit is designed to pivot about a pre-determined point or cross-section. In at least one other embodiment, the mill bit is also able to effectively cut when translating up-hole, for example using oppositely oriented cutting features. In at least one other embodiment, provided is a unique whipstock having a whipstock taperface that is configured to interact with the different sections of the mill bit so that the mill bit path can be controlled.

In one or more embodiments, the present disclosure selects, and places different sections of the mill bit relative to one another to produce a desired material removal rate and wear rate at a contact point between the mill bit and the casing, as well as at a contact point between the mill bit and the whipstock. In at least one embodiment, the cutter selection and placement are chosen to produce a milling assembly pivot point (e.g., rotation point). Further to at least one embodiment, the whipstock taperface geometry is designed to produce specific contact with predetermined sections of the mill bit, so that the casing material is removed at a greater rate (e.g., 50% greater, 100% greater, 200% greater, 500% greater, or more) than the whipstock material. For example, a ramp angle and concave diameter of the whipstock taperface geometry may be varied to control the path of the milling assembly. Furthermore, the cutter selection and placement on a lead mill bit or a watermelon mill bit may be designed such that the mill bits are effective cutters while translating uphole (e.g., during reaming).

A milling system designed, manufactured, and operated according to one embodiment of the disclosure is capable of milling a complete window in the casing and rat hole in the formation using a single trip. Accordingly, a milling system according to the disclosure is capable of saving considerable time and expense.

Figure 1:
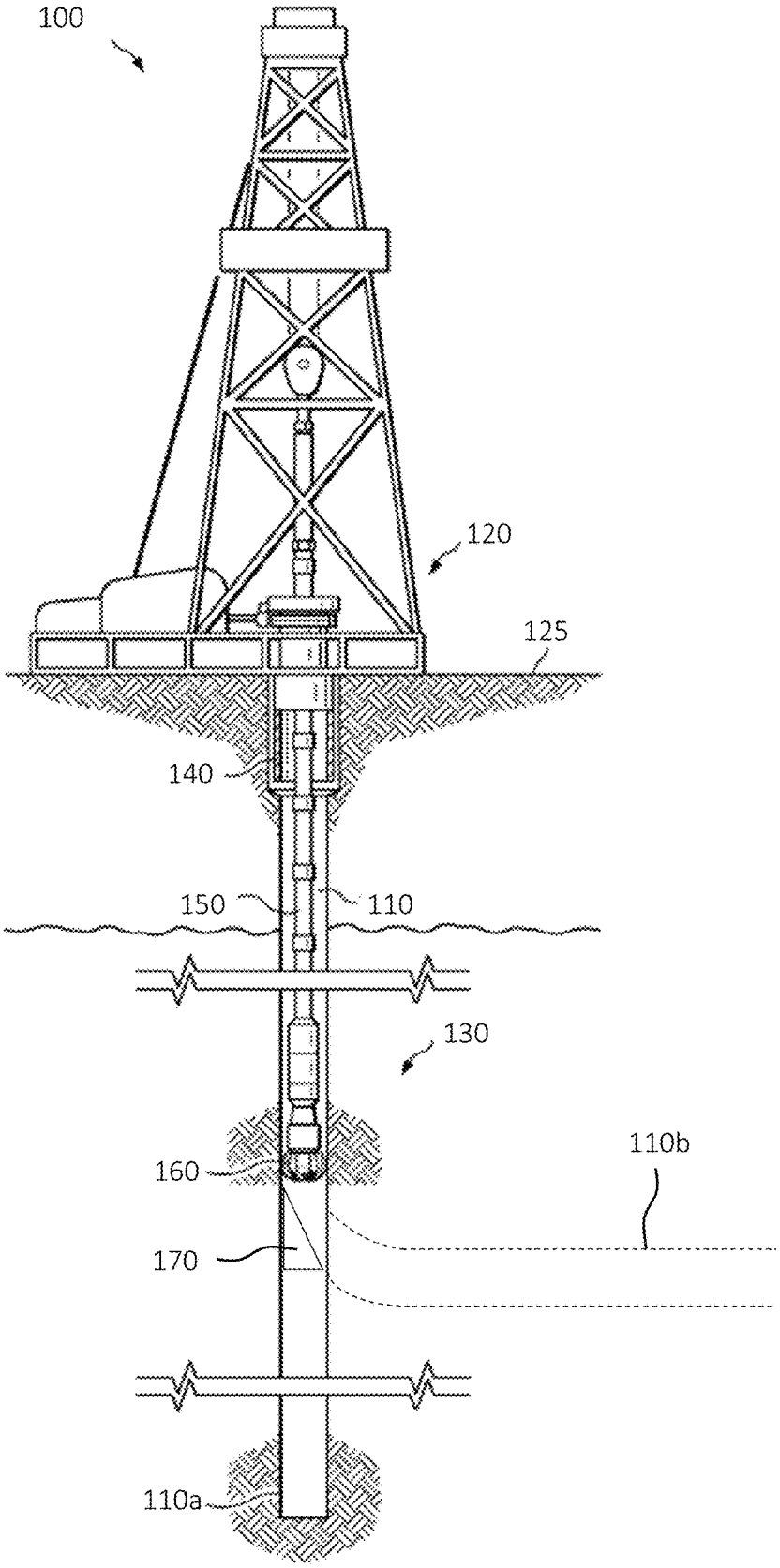
FIG. 1 illustrates a schematic partial cross-sectional view of an example well system designed, manufactured, and formed according to one embodiment of the disclosure.

FIG. 1 is a schematic partial cross-sectional view of an example well system 100 that generally includes a wellbore 110 extending from a wellhead 120 at the surface 125 downward into the Earth into one or more subterranean zones of interest (one subterranean zone of interest 130 shown). The subterranean zone 130 can correspond to a single formation, a portion of a formation, or more than one formation accessed by the well system 100. Furthermore, a given well system 100 can access one, or more than one, subterranean zone 130. After some or all of the wellbore 100 is drilled, a portion of the wellbore 100 extending from the wellhead 120 to the subterranean zone 130 may be lined with lengths of tubing, called casing 140.

The depicted well system 100 is a vertical well, with the wellbore 100 extending substantially vertically from the surface 125 to the subterranean zone 130. The concepts herein, however, are applicable to many other different configurations of wells, including horizontal, slanted or otherwise deviated wells, and multilateral wells with legs deviating from an entry well. For example, in the embodiment of FIG. 1, the wellbore 110 includes a main wellbore portion 110*a*, and a lateral wellbore portion 110*b*.

A drill string 150 is shown as having been lowered from the surface 125 into the wellbore 110. In some instances, the drill string 150 is a series of jointed lengths of tubing coupled together end-to-end and/or a continuous (e.g., not jointed) coiled tubing. The drill string 150 includes one or more well tools, including a bottom hole assembly 160. The bottom hole assembly 160 can include, for example, a mill bit or drill bit designed, manufactured and operated according to one or more embodiments of the disclosure. In the example shown, the main wellbore portion 110*a* has been drilled, and the lateral wellbore portion 110*b* is about to be drilled.

In at least one embodiment, a whipstock 170 designed, manufactured and operated according to one or more embodiments of the disclosure may be employed to redirect the bottom hole assembly 160, and particularly the mill bit, against the sidewall of the casing 140 and into the formation, thereby forming the lateral wellbore portion 110*b*. In at least one embodiment, a single bottom hole assembly 160, and thus a single mill bit, may be used to create the opening in the casing 140 and a rat hole in the formation 130. In accordance with at least one embodiment, the bottom hole assembly 160 could be pulled out of hole, and replaced with a bottom hole assembly including a drill bit, for example to complete the lateral wellbore portion 110*b*.

The present disclosure provides a mill bit designed with multiple sections, which could each have a unique material removal rate (e.g., cutting rate), for example based upon its interaction with the casing 140 and the whipstock 170. These sections could all be unique, or some could be the same and some could be different.

Figure 2A:
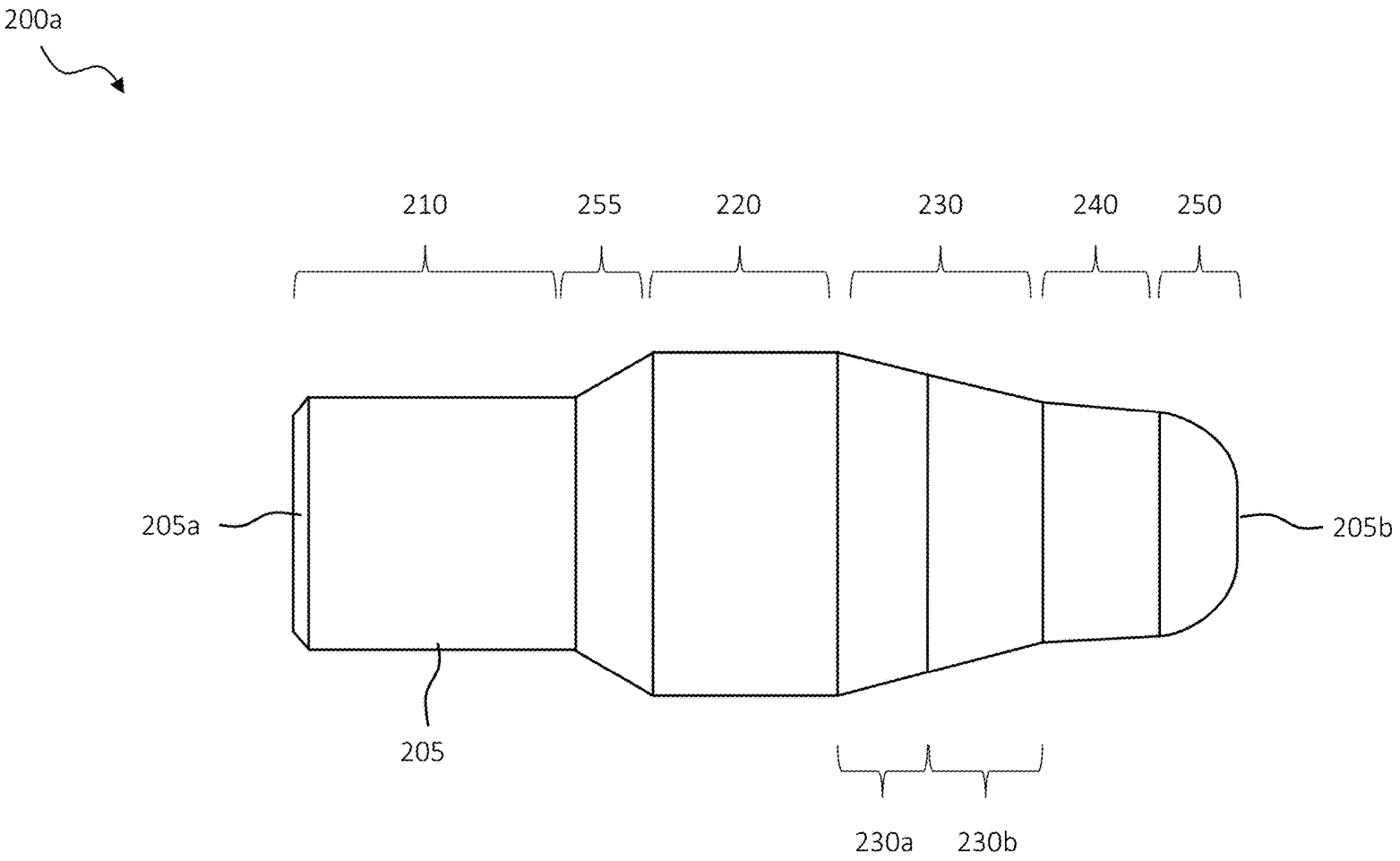
FIGS. 2A through 2C illustrate a mill bit designed, manufactured, and/or operated according to one embodiment of the disclosure.

FIG. 2A illustrates one profile of a mill bit 200*a* designed, manufactured, and/or operated according to one embodiment of the disclosure. The mill bit 200*a*, in the illustrated embodiment, includes a tubular 205, having an uphole end 205*a* and a downhole end 205*b*. The mill bit 200*a*, in accordance with one embodiment of the present disclosure, includes a first cutting section (e.g., gauge section 220) having one or more first cutting surfaces (e.g., cutting surfaces 222 of FIG. 2B) disposed about the tubular 205. The first cutting section, in accordance with one embodiment, has a first material removal rate, and is configured to engage with wellbore casing disposed within a wellbore. The mill bit 200*a*, in accordance with one embodiment of the present disclosure, additionally includes a second cutting section (e.g., second taper portion 230*b*) having one or more second cutting surfaces (e.g., cutting surfaces 232 of FIG. 2B) disposed about the tubular 205. The second cutting section, in accordance with at least one embodiment, has a second material removal rate less than the first material removal rate, and is configured to engage with a whipstock disposed within the wellbore. In at least one embodiment, the one or more first cutting surfaces are positioned radially outside of the one or more second cutting surfaces. In at least one embodiment, any cutting section of the mill bit 205*a* may comprise the first cutting section having the first material removal rate, and any other section of the mill bit 205*a* may comprise the second cutting section having the second material removal rate less than the first material removal rate.

In the specific embodiment of FIG. 2A, the first cutting section is a gauge section 220 and the second cutting section is a downhole taper section 230 (e.g., located between the gauge section 220 and the downhole end 205*b*). For example, in at least one embodiment the downhole taper section 230 includes a first taper portion 230*a* located adjacent to the gauge section 220 and a second taper portion 230*b* located more proximate the downhole end 205*b*. In at least one embodiment, the second taper portion 230*b* of the downhole taper section 230 has the second material removal rate.

The mill bit 200*a*, in at least one embodiment, further includes a transition section 240, for example having one or more transition section cutting surfaces (e.g., cutting surfaces 242 of FIG. 2B) disposed about the tubular 205 between the second taper portion 230*b* and the downhole end 205*b*. In at least one embodiment, the transition section 240 has a third material removal rate less than the first material removal rate of the gauge section 220. Furthermore, in at least one embodiment, the second material removal rate of the second taper portion 230*b* and the third material removal rate are similar material removal rates. The transition section 240, in at least one embodiment, is the portion of the mill bit 200*a* that couples (e.g., via a shear feature in one embodiment) to a coupling section of a whipstock (e.g., a muleshoe of a whipstock). Furthermore, in at least one embodiment, the transition section 240 and the taper section 230 may comprise a single angled section (e.g., forming a straight line).

The mill bit 200*a*, in at least one embodiment, further includes a nose section 250 having one or more nose section cutting surfaces (e.g., cutting surfaces 252 of FIG. 2B) disposed about the tubular 205. In at least one embodiment, the nose section 205 is positioned between the transition section 240 and the downhole end 205*b*. In accordance with one embodiment, the nose section 250 has a fourth material removal rate greater than the second material removal rate of the second taper portion 230*b*. In at least one embodiment, the fourth material removal rate and the first material removal rate of the gauge section 220 are similar material removal rates.

The mill bit 200*a*, in at least one embodiment, additionally includes an uphole taper section 255 having one or more uphole taper section cutting surfaces (e.g., cutting surfaces 258 of FIG. 2B) disposed about the tubular 205. For example, in at least one embodiment the uphole taper section 255 is located between the uphole end 205*a* and the gauge section 220. In one or more embodiments, the uphole taper section cutting surfaces are oppositely oriented to the one or more first cutting surfaces of the gauge section 220. In such an embodiment, the uphole taper section cutting surfaces would be configured to mill the wellbore casing when translating uphole. In at least one other embodiment, the uphole taper section cutting surfaces are oppositely oriented to the one or more first cutting surfaces of the gauge section 220, one or more second cutting surfaces of the downhole taper section 230, one or more transition section cutting surfaces of the transition section 240, and the one or more nose section cutting surfaces of the nose section 250.

Figure 2B:
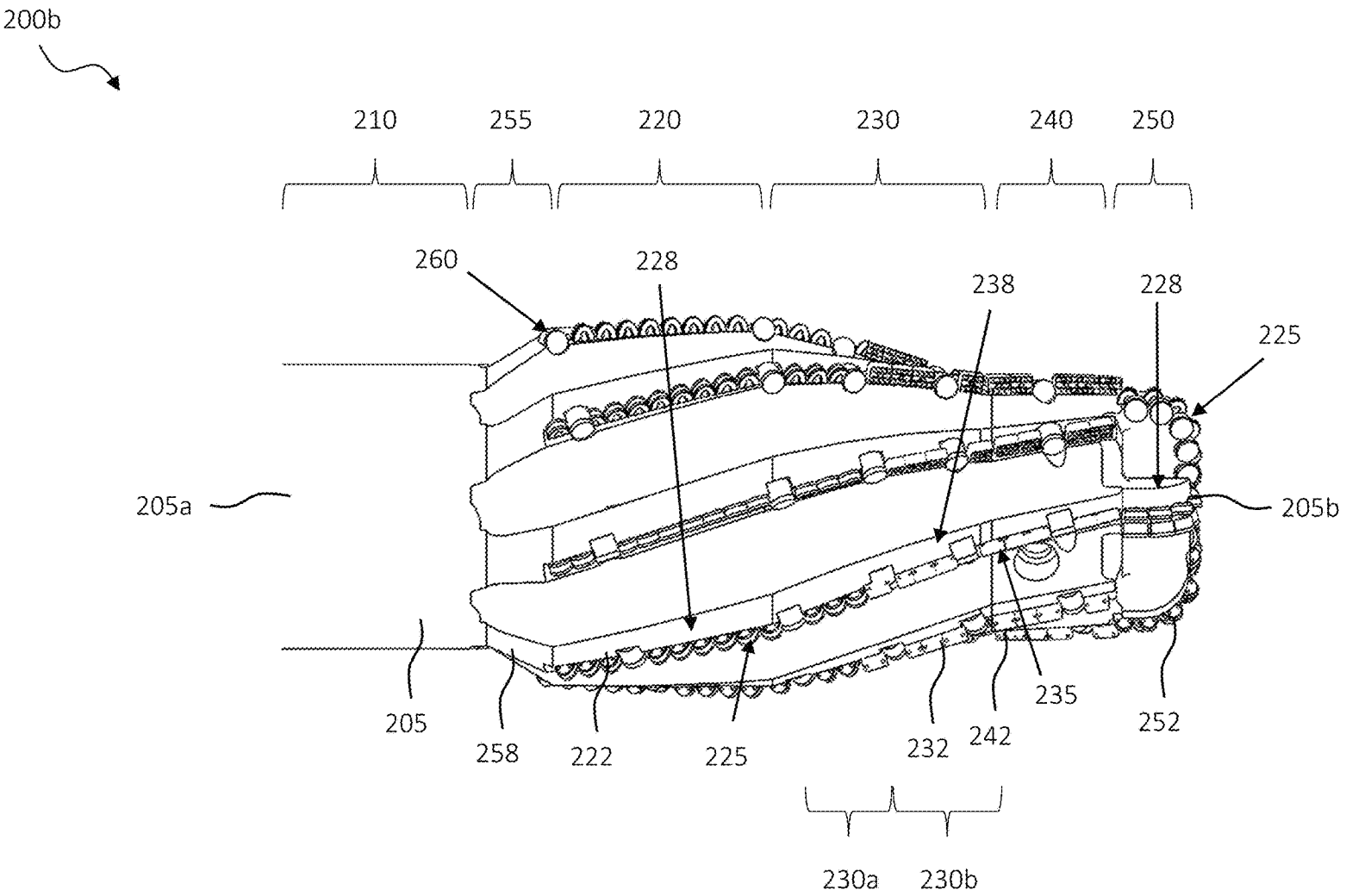

Turning to FIG. 2B, illustrated is an alternative embodiment of a mill bit 200*b* designed, manufactured and/or operated according to one or more embodiments of the disclosure. The mill bit 200*b* in similar in many respects to the mill bit 200*a*. Accordingly, like reference numbers have been used to indicated similar, if not identical, features. In the embodiment of FIG. 2B, a density of the one or more first cutting surfaces 222 in the gauge section 220 is less than a density of the one or more second cutting surfaces 232 in the downhole taper section 230. In at least one embodiment, the different densities provide greater cutting pressure in the gauge section 220 and lesser cutting pressure in the downhole taper section 230 (e.g., second taper portion 230*b*). In the embodiment of FIG. 2B, rectangular carbide cutters 235 and a tightly distributed carbide chunk backing 238 are used in the downhole taper section 230, and oval cutting cutters 225 and loosely distributed carbide chunk backing 228 are used in the gauge section 220. In yet another embodiment, the oval cutting cutters 225 and the loosely distributed carbide chunk backing 228 are used in the gauge section 220 In one or more embodiments, the tightly and loosely distributed carbide chunk backing 238, 228 comprise crushed carbide hard facing.

Figure 2C:
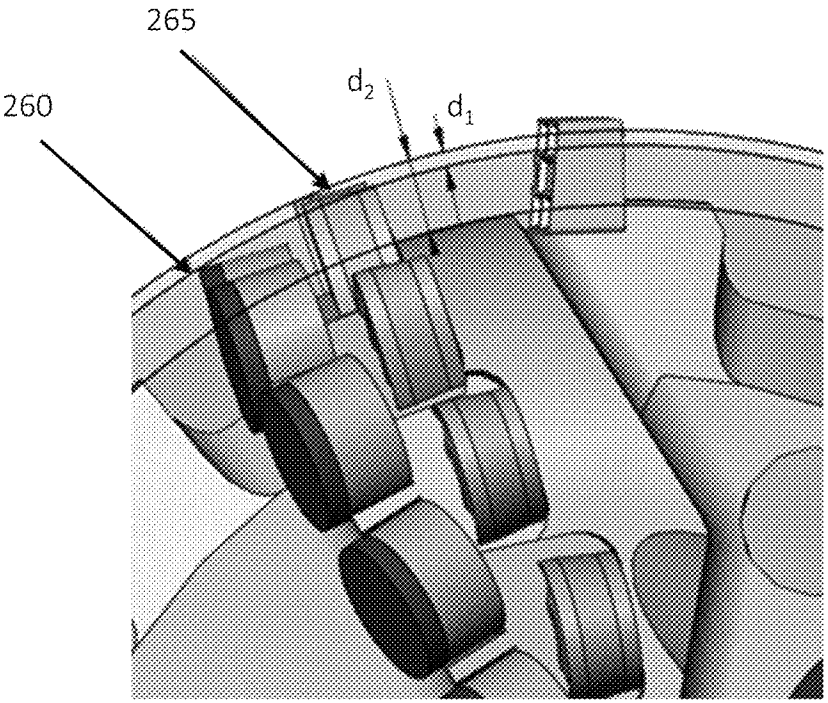

In the illustrated embodiment, the gauge section 220 includes only a single Polycrystalline Diamond Compact (PDC) cutter 260 whereas the downhole taper section 230 includes two or more Polycrystalline Diamond Compact (PDC) cutters 260. Further to this embodiment, the nose section 250 has three or more Polycrystalline Diamond Compact (PDC) cutters 260. As shown in FIG. 2C, the nose section 250 includes three or more Tungsten Carbide Insert (TCI) cutters 265 that are radially outside of the three or more Polycrystalline Diamond Compact (PDC) 260 cutters by a distance ($d_1$), for example of at least 1.27 mm. As shown in FIG. 2C, the three or more Tungsten Carbide Insert (TCI) cutters 265 are radially outside of the tubular 205 by a distance ($d_2$).

Figure 3A:
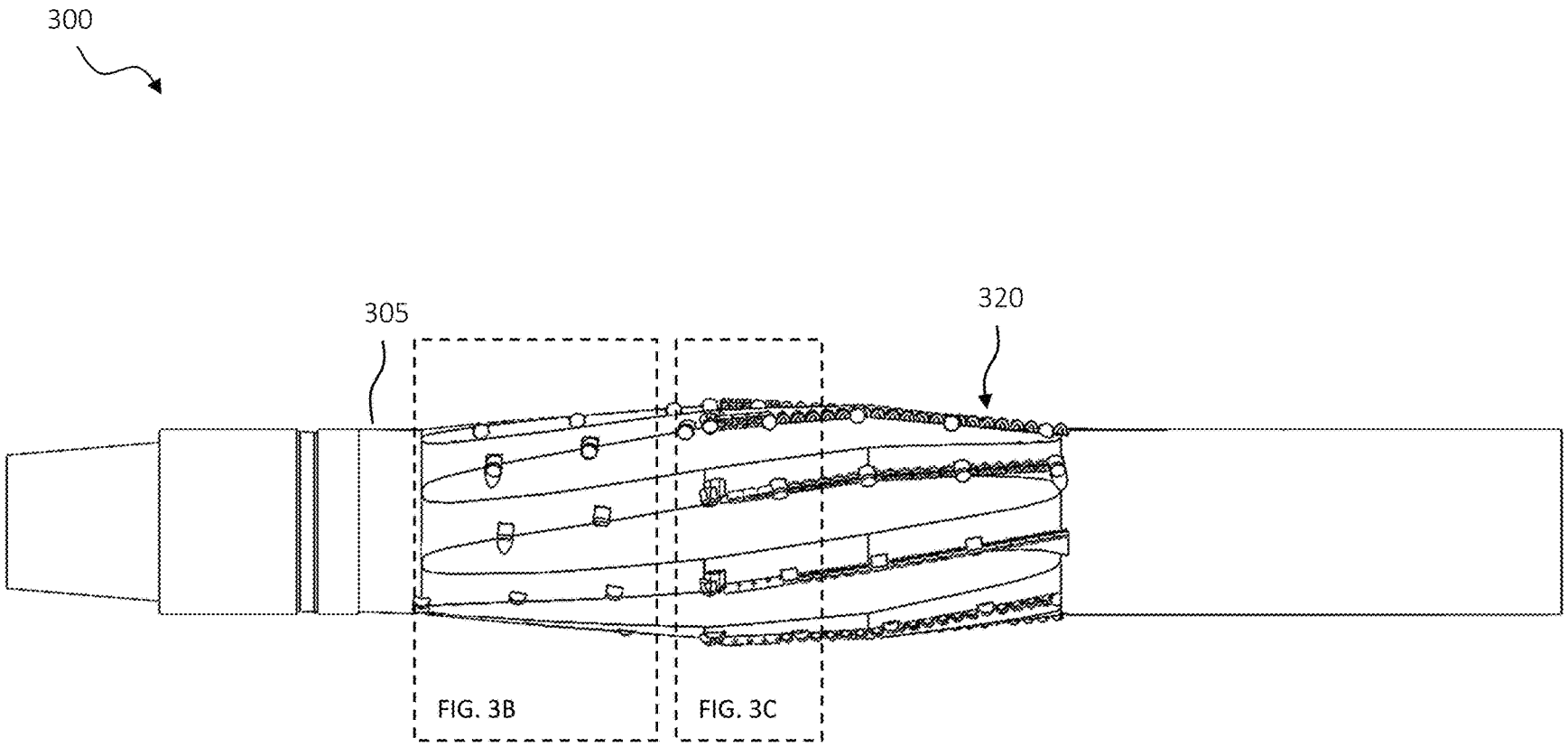
FIGS. 3A through 3C illustrate various different views a watermelon mill designed, manufactured and/or operated according to one embodiment of the disclosure.
Figure 3B:
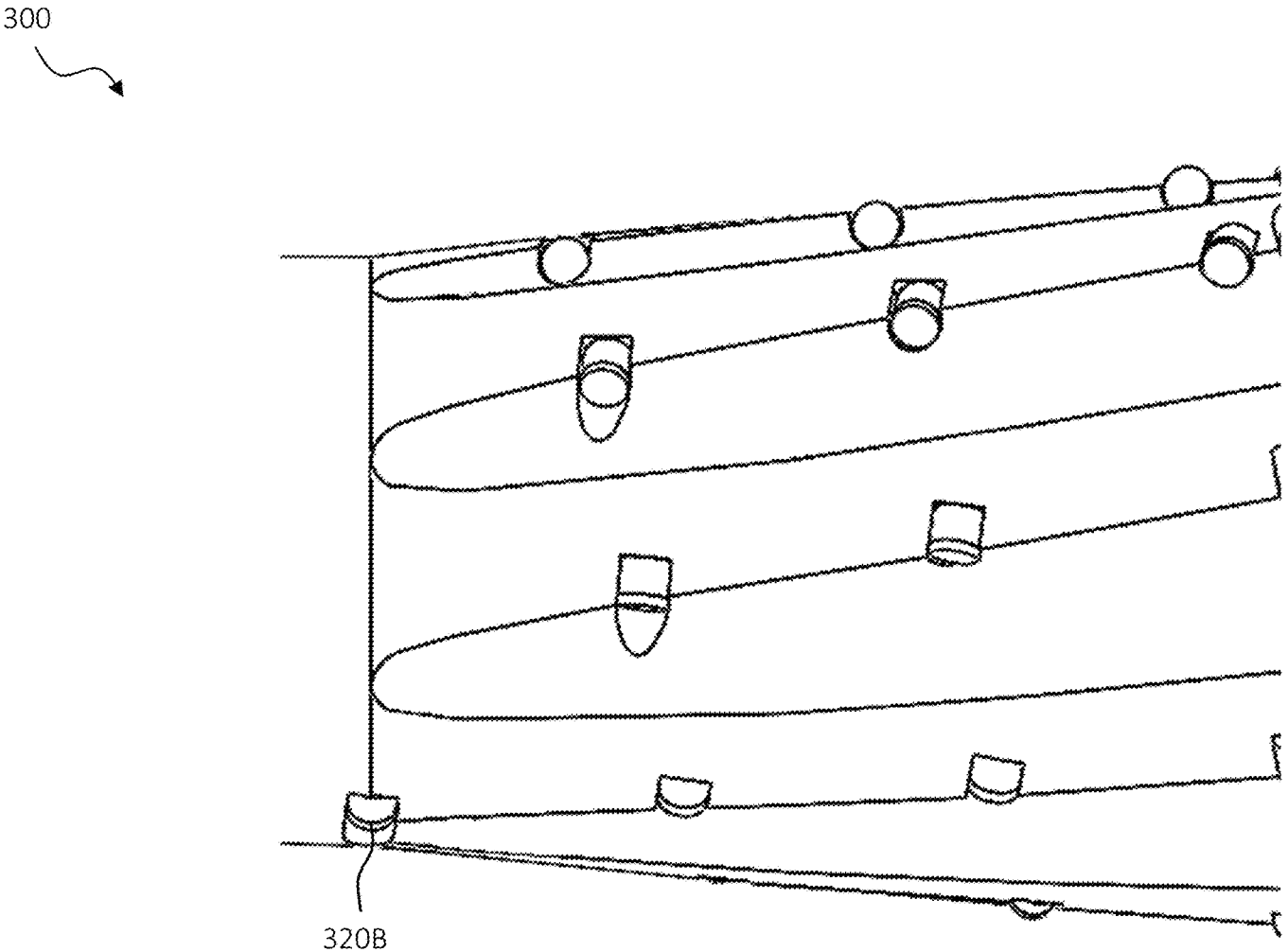
Figure 3C:
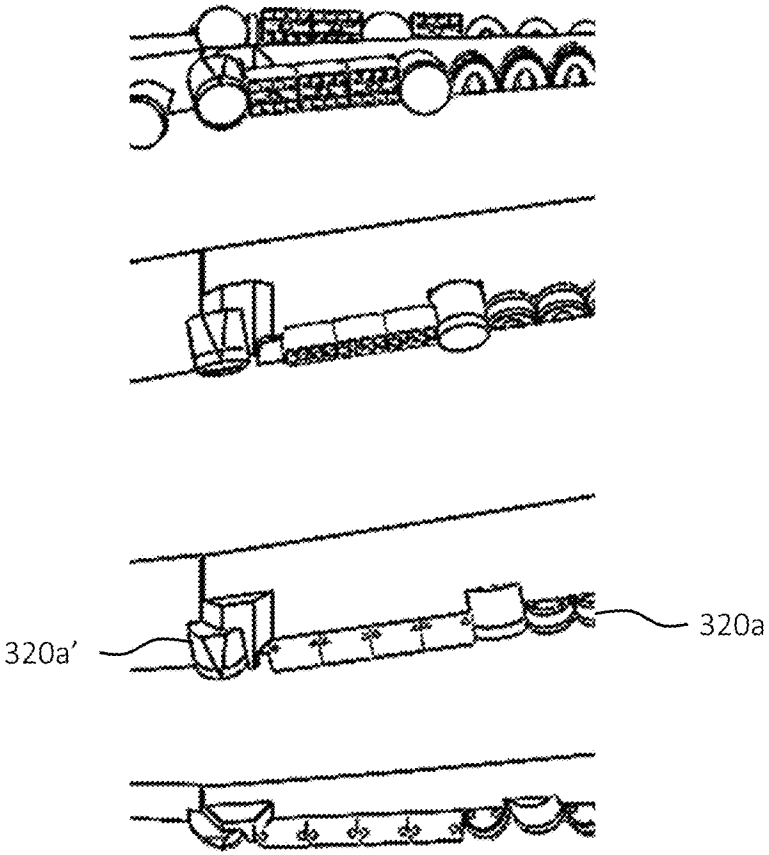

Turning to FIGS. 3A through 3C, illustrated are various different views of a watermelon mill 300 designed, manufactured and/or operated according to one or more embodiments of the disclosure. The watermelon mill 300, in at least one embodiment, includes a tubular 305. In the illustrated embodiment, the watermelon mill 300 includes one or more cutters 320. In at least one embodiment, at least one cutter 320*a* of the one or more cutters 320 are oppositely oriented to others 320*b* of the one or more cutters 320. For example, the oppositely oriented cutters 320*b* (e.g., Polycrystalline Diamond Compact (PDC) inserts) could be set with an axial rake to allow cutting action when the watermelon mill 300 is translating uphole. Further, at least one 320*a*' of the one or more cutters 320 (e.g., Polycrystalline Diamond Compact (PDC) inserts) could be set at a pivot point on the watermelon mill 300.

Both the mill bit (e.g., mill bit 200) and watermelon mill (e.g., watermelon mill 300) have been designed to effectively mill through steel and formation by selecting both carbide and Polycrystalline Diamond Compact (PDC) cutters. Carbide cutters are sometimes preferred for cutting steel and PDC cutters are sometimes preferred for cutting formation, although PDC have been shown to be effective at cutting steel if certain conditions are maintained (e.g., max temperature, max shock load). Both mills may be arranged so that carbide cutters protect the PDC cutters by standing proud of the PDC cutters and engaging the steel whipstock and casing without allowing the PDC cutters to engage. As the mills move through the window milling process, the carbide cutters will chip/wear away and eventually allow the PDC cutters to engage. Ideally this happens just as the mill leaves the casing so that PDC only engage formation, however it is acceptable for the PDC to become exposed prior to exiting casing.

When milling a window, the milling assembly (e.g., mill bit and watermelon mill bit) rotate so that the mill bit can climb the whipstock. Designing a milling assembly with a predetermined point of rotation allows the mill assembly to perform as desired and allows the milling simulation to better represent the mill path. In this mill assembly, the watermelon mill bit has been designed with a pivot point at the up-hole edge of the gauge section. This is accomplished, in at least one embodiment, by placing PDC cutters (e.g., inserts) at the pivot location and setting them with a 0° relief and radial rake angle. Setting the PDC cutters (e.g., inserts) like this will cause them to behave as a wear point that does not cut effectively. FIG. 3 illustrates the watermelon mill 300 with row of PDC as described above.

Both mills may be designed to be effective for cutting when the mill assembly is translating up-hole (reaming). Because the cutters (e.g., inserts) require axial rake angle to engage the material being cut, a standard cutter cannot effectively engage when translating both down-hole and up-hole. Typically, the cutter (e.g., insert) is set to engage when translating down-hole only. To engage when translating up-hole, dedicated reaming cutters may be placed with a preferred axial rake, and for example pointed in an opposite direction as the typical down-hole cutters (e.g., inserts).

Figure 4A:
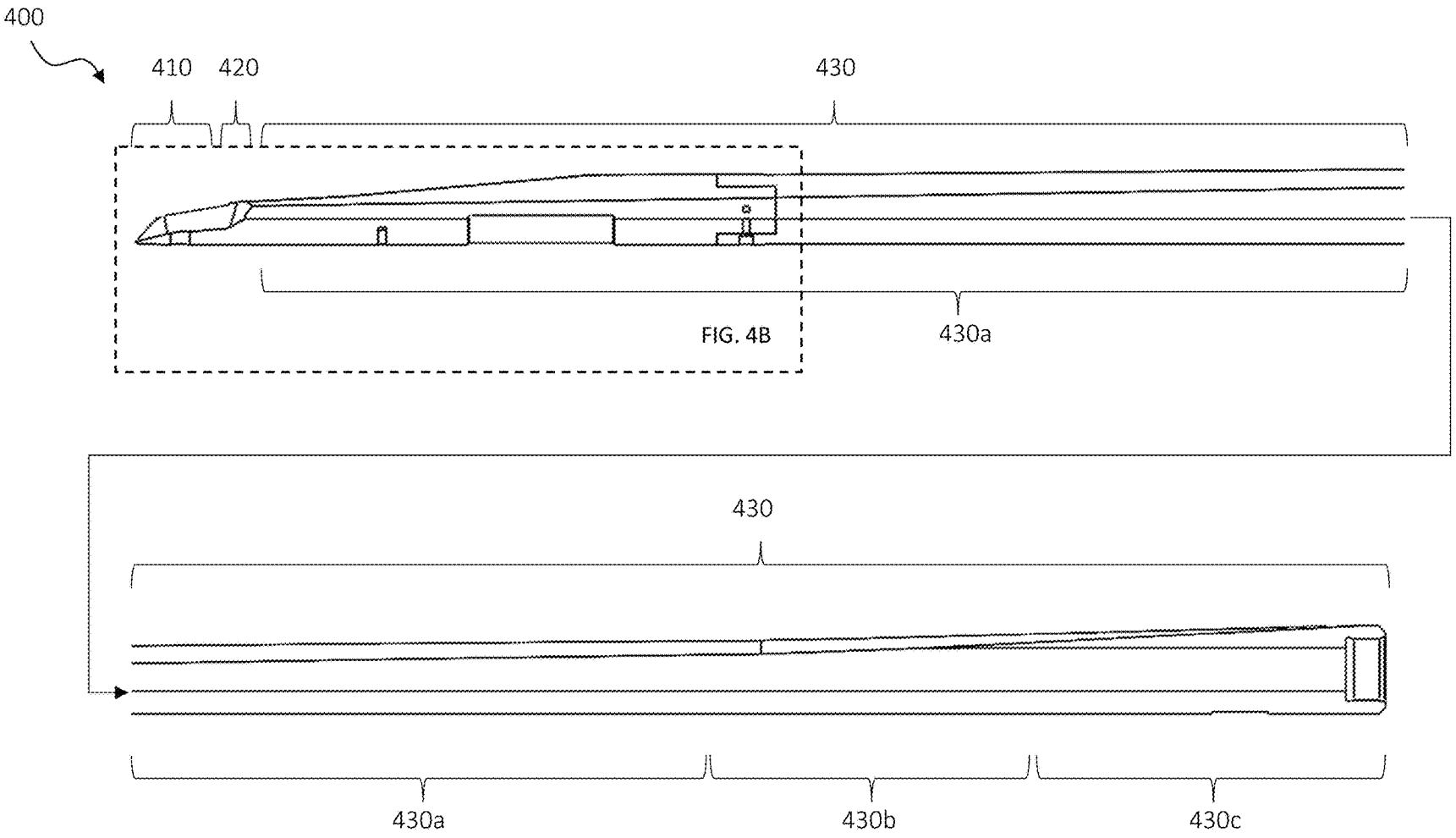
FIGS. 4A through 4C illustrate various views of a whipstock designed, manufactured and/or operated according to one or more embodiments of the disclosure.
Figure 4B:
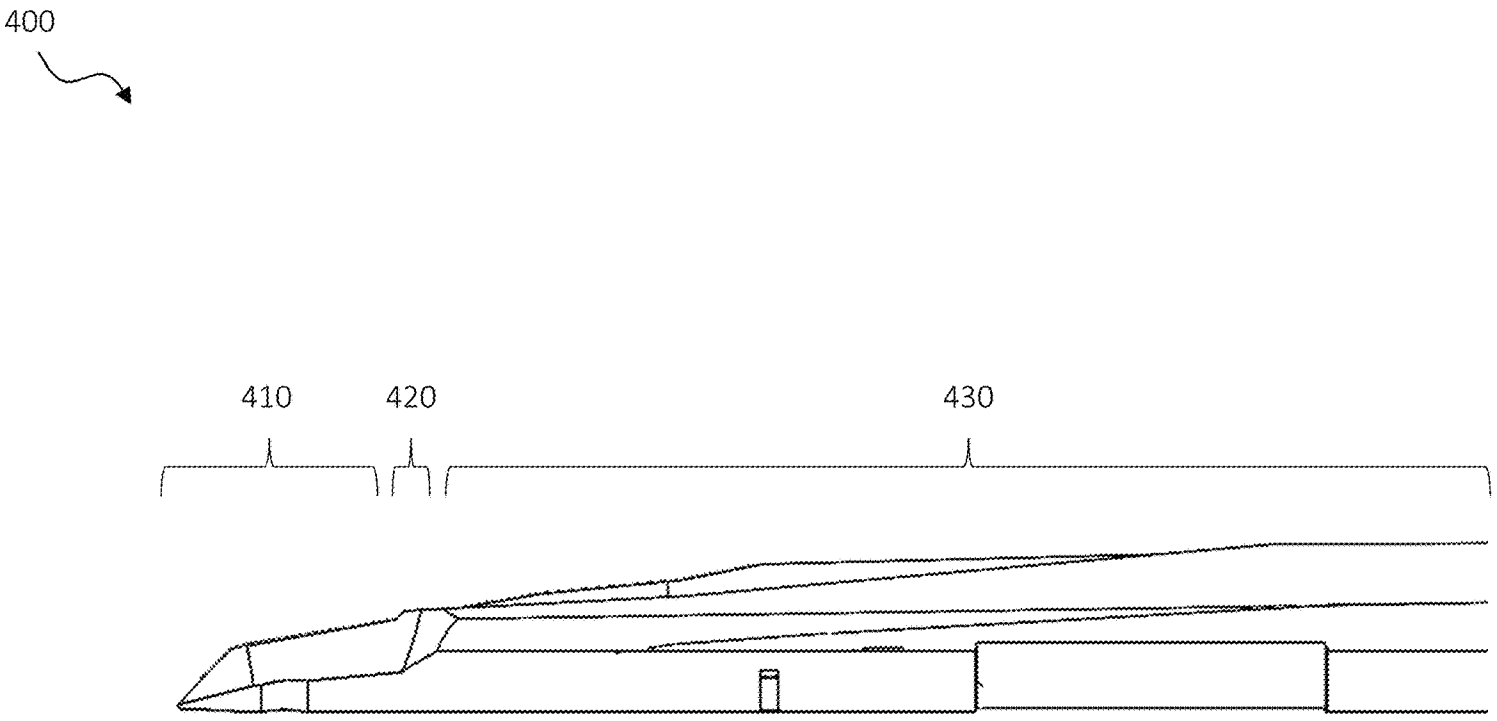
Figure 4C:
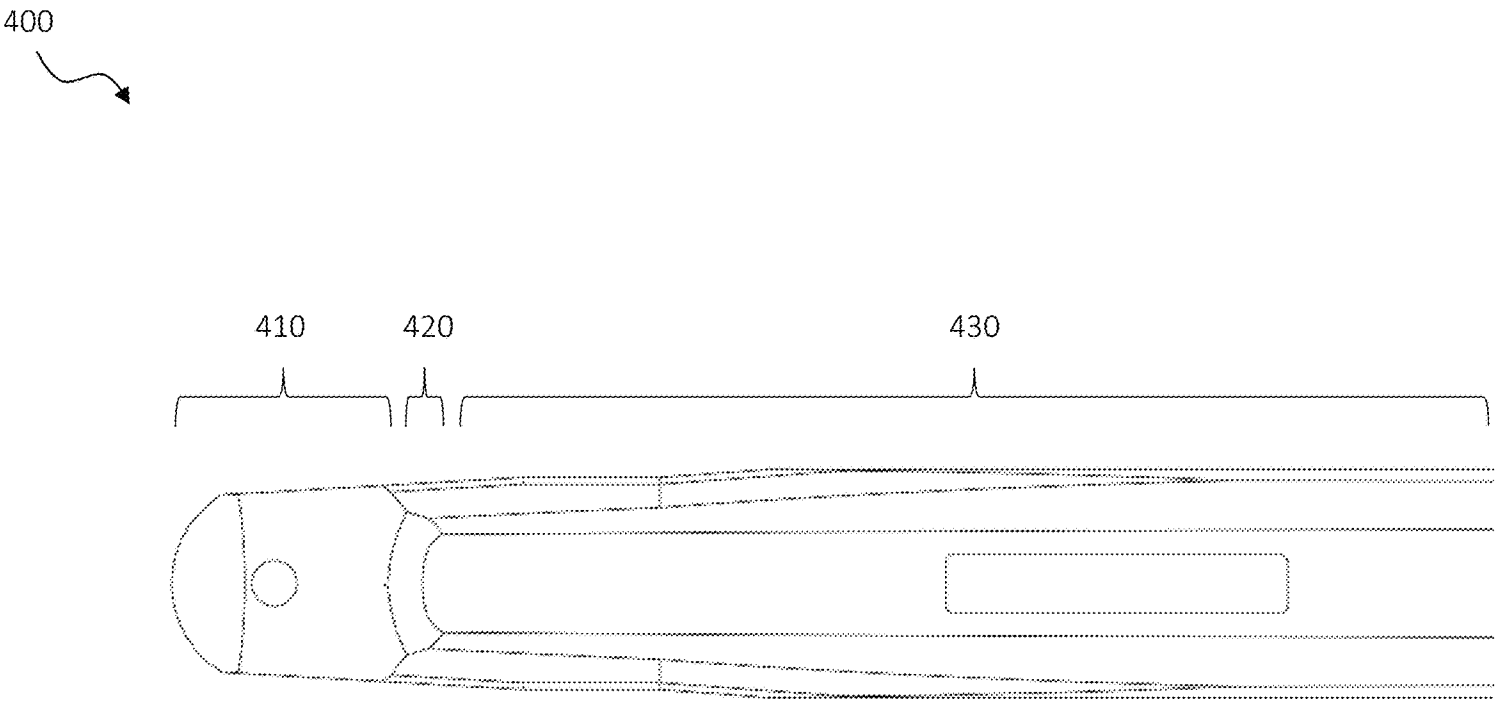

Turning now to FIGS. 4A through 4C, illustrated are different views of a whipstock 400 designed, manufactured and/or operated according to one or more embodiments of the disclosure. The whipstock 400, in at least on embodiment, includes a coupling section 410. The coupling section 410, in accordance with the disclosure, has a first concave portion having a first radius of curvature. In the illustrated embodiment, the coupling section 410 is configured to engage with a mill bit when running in hole. The whipstock 400, in the illustrated embodiment, further includes a casing breakthrough section 420 having a second concave portion having a second radius of curvature. The whipstock 400, in the illustrated embodiment, additionally includes a controlled exit section 430 having a third concave section having a third radius of curvature.

In accordance with one embodiment, the second radius of curvature is less than the third radius of curvature. For example, in at least one embodiment the second radius of curvature is at least 5% less than the third radius of curvature. In yet another embodiment, the second radius of curvature is at least 10% less than the third radius of curvature, if not at least 25% less. In yet another embodiment, the second radius of curvature is also less than the first radius of curvature. Furthermore, in yet another embodiment the third radius of curvature is also less than the first radius of curvature.

In at least one embodiment, the second radius of curvature are at least 2% smaller than the radius of the lower taper section (e.g., lower taper section 230*b*) and/or transition section (e.g., transition section 240) of the mill bit it is to engage. In at least one other embodiment, it is 5% less, 10% less, 25% less, or more. Accordingly, the casing break through section 420 includes more material (e.g., sacrificial material). This is in contrast to existing whipstocks, which would have a concave portion that has a matching diameter to the mill bit.

Further to the embodiment of FIGS. 4A through 4C, in at least one embodiment the coupling section 410 has a first ramp rate, the casing breakthrough section 420 has a second ramp rate, and the controlled exit section 430 has a third ramp rate. In the illustrated embodiment, the first ramp rate is less than the second ramp rate but greater than the third ramp rate. For example, in at least one embodiment, the second ramp rate is at least six times the first ramp rate.

Further to the embodiment of FIGS. 4A through 4C, the controlled exit section 430 includes a downhole portion 430*a* with a downhole portion ramp rate, a middle portion 430*b* with a middle portion ramp rate, and an uphole portion 430*c* with an uphole portion ramp rate. In at least one embodiment, the downhole portion ramp rate is less than the middle portion and uphole portion ramp rates. For example, in at least one embodiment, the downhole portion ramp rate is approximately ⅓ of the middle portion and uphole portion ramp rates. In yet another embodiment, the middle portion and uphole portion ramp rates are about equal, but the middle portion 430*b* has a slightly smaller radius of curvature than the uphole portion 430*c*. Furthermore, the downhole portion 430*a* has a slightly smaller radius of curvature than a radius of curvature of the middle portion 430*b* and the uphole portion 430*c*.

Turning briefly to FIG. 5A, illustrated is the mill bit 200 of FIG. 2A, which has been positioned within casing 510 located within formation 520. In the illustrated embodiment, the mill bit 200 is riding up the whipstock 400 of FIGS. 4A through 4C, thereby forming an opening in the casing 510. Again, in this embodiment, an interaction between the mill bit 200 and the whipstock 400, and particularly the different removal rate sections of the mill bit 200 discussed in the paragraph above, cause the mill bit 200 to have a higher degree of removal of the casing 510 than the whipstock 400.

Turning to FIG. 5B, illustrated is one example embodiment 550 of how a mill bit 200 may contact the whipstock 400 and the casing 510, for example of FIG. 5A. The example embodiment 550 shows that a contact region 560 with the whipstock 400 is primarily with the mill section of less material removal rate, and a contact region 570 with the casing 510 is primarily with the section of greater material removal rate.

This targeted contact creates a window with early initial casing breakthrough. Material removal rate of the different sections of the mill bit is controlled by cutter selection, cutter placement, cutter orientation, crushed carbide backing selection, crushed carbide backing chunk distribution, amount of grinding performed on mill OD, among other features.

Turning now to FIG. 6, illustrated is a mill assembly 600, including a mill bit 610 and watermelon mill bit 620, assembled to a whipstock 630 via a shear bolt for running in hole, all of which is positioned within casing 680 positioned within a formation 690. The mill bit 610 may be similar to any of the mill bits disclosed above, the watermelon bit 620 may be similar to any of the watermelon bits disclosed above, and the whipstock 630 may be similar to any of the whipstocks disclosed above.

Figure 7:
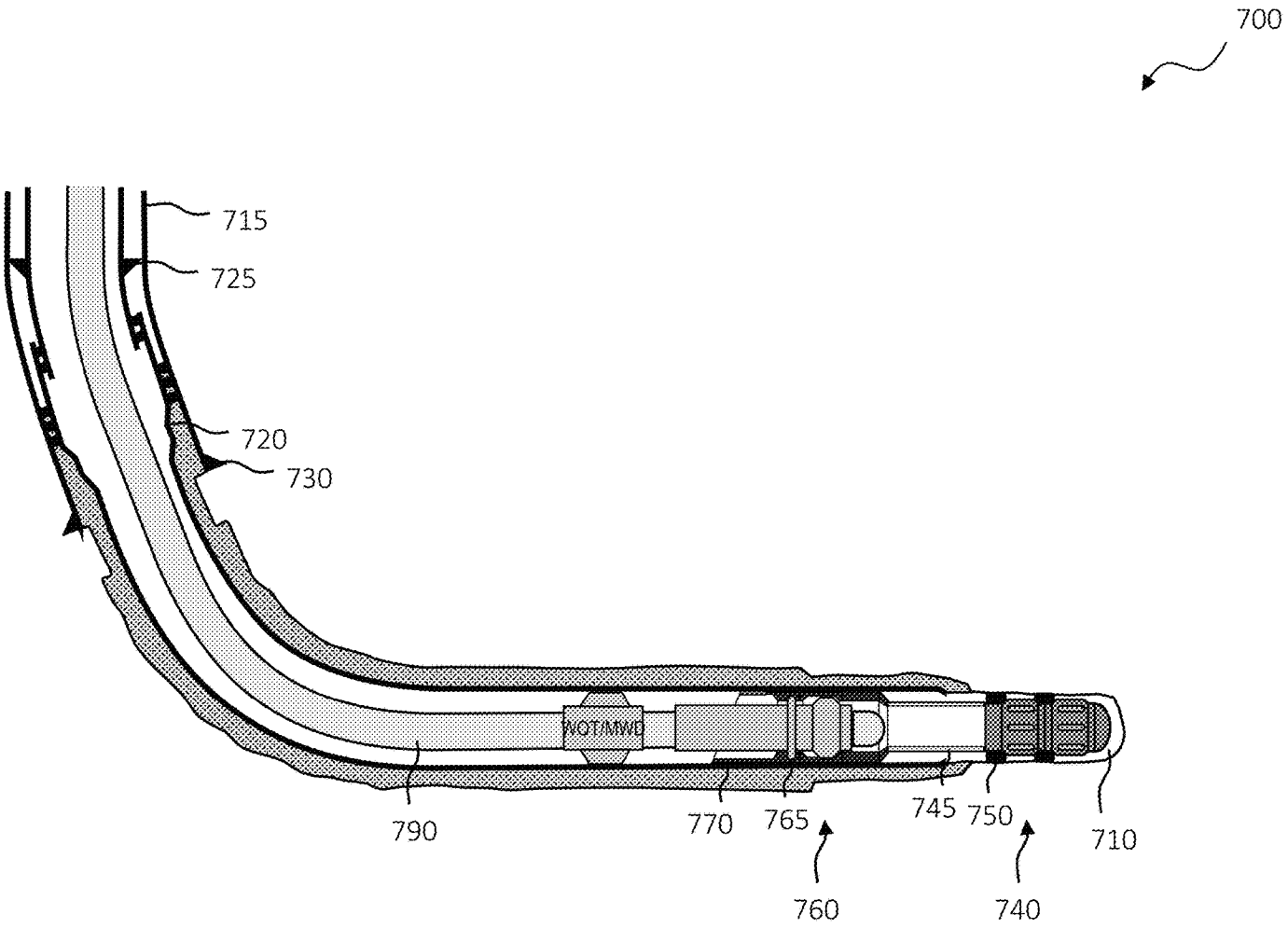

Turning now to FIGS. 7 through 19, illustrated is a method for forming, accessing, potentially fracturing, and producing from a well system 700. FIG. 7 is a schematic of the well system 700 at the initial stages of formation. A main wellbore 710 may be drilled, for example by a rotary steerable system at the end of a drill string and may extend from a well origin (not shown), such as the earth's surface or a sea bottom. The main wellbore 710 may be lined by one or more casings 715, 720, each of which may be terminated by a shoe 725, 730.

The well system 700 of FIG. 7 additionally includes a main wellbore completion 740 positioned in the main wellbore 710. The main wellbore completion 740 may, in certain embodiments, include a main wellbore liner 745 (e.g., with frac sleeves in one embodiment), as well as one or more packers 750 (e.g., swell packers in one embodiment). The main wellbore liner 745 and the one or more packer 750 may, in certain embodiments, be run on an anchor system 760. The anchor system 760, in one embodiment, includes a collet profile 765 for engaging with the running tool 790, as well as a muleshoe 770 (e.g., slotted alignment muleshoe). A standard workstring orientation tool (WOT) and measurement while drilling (MWD) tool may be coupled to the running tool 790, and thus be used to orient the anchor system 760.

Figure 8:
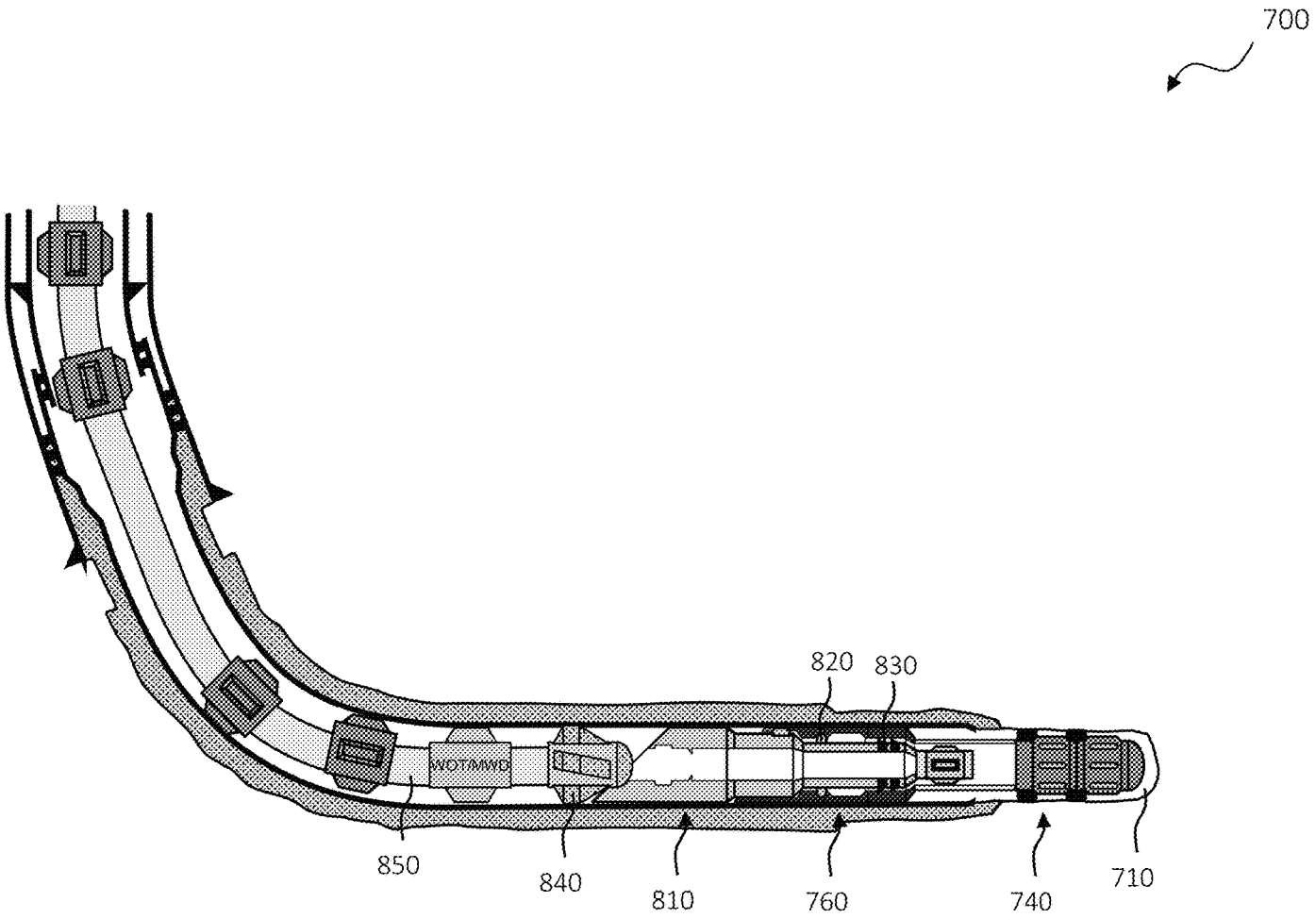

Turning to FIG. 8, illustrated is the well system 700 of FIG. 7 after positioning a whipstock assembly 810 downhole at a location where a lateral wellbore is to be formed. The whipstock assembly 810, in at least one embodiment, includes a collet 820 for engaging the collet profile 765 in the anchor system 760. The whipstock assembly 810 additionally includes, in one or more embodiments, one or more seals 830 (e.g., a wiper set in one embodiment) to seal the whipstock assembly 810 with the main wellbore completion 740. In certain embodiments, such as that shown in FIG. 8, the whipstock assembly 810 is made up with a lead mill bit 840, for example using a shear bolt, and then run in hole on a drill string 850. The lead mill bit 840 and the whipstock assembly 810 may comprise one or more of the mill bits and/or whipstocks discussed in the paragraphs above. The WOT/MWD tool may be employed to orient the whipstock assembly 810.

Figure 9:
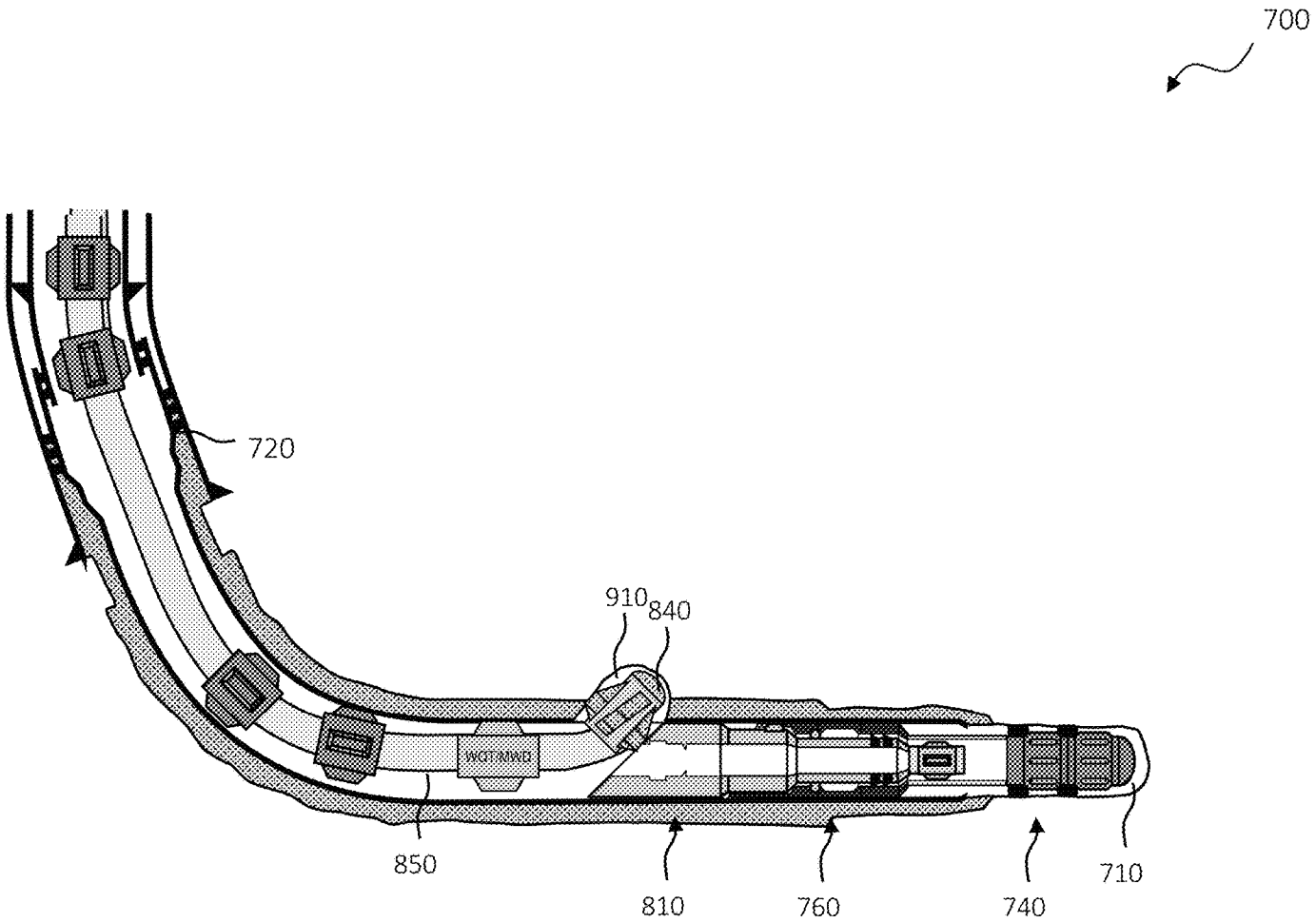

Turning to FIG. 9, illustrated is the well system 700 of FIG. 8 after setting down weight to shear the shear bolt between the lead mill bit 840 and the whipstock assembly 810, and then milling an initial window pocket 910. In certain embodiments, the initial window pocket 910 is between 1.5 m and 7.0 m long, and in certain other embodiments about 2.5 m long, and extends through the casing 720. Thereafter, a circulate and clean process could occur, and then the drill string 850 and lead mill 840 may be pulled out of hole. As discussed above, the lead mill bit 840 may be designed to remove casing 720 while moving down-hole and up-hole in a reaming process, as well as remove casing 720 when being withdrawn out of the opening.

Figure 10:
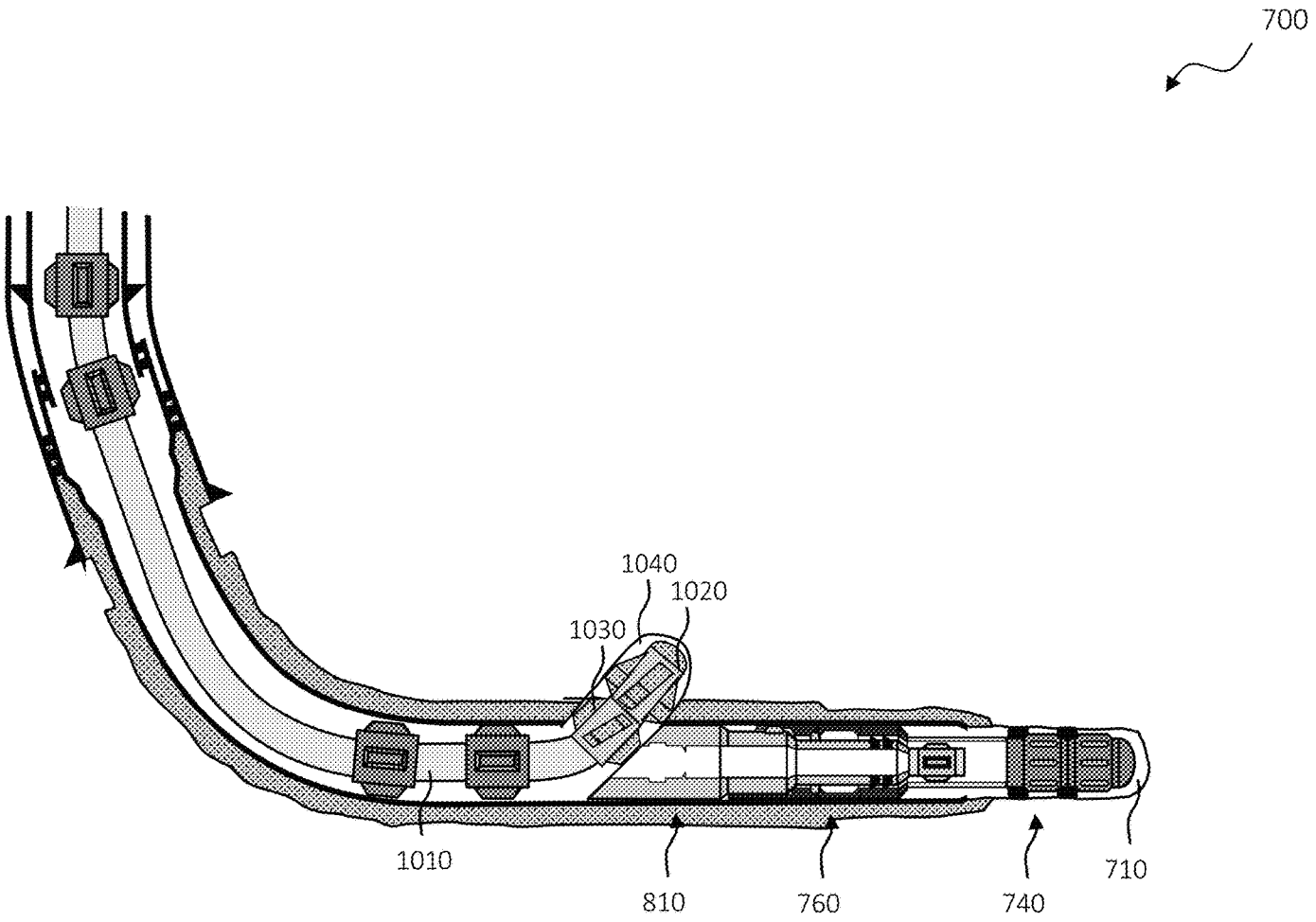

Turning to FIG. 10, illustrated is the well system 700 of FIG. 9 after running a lead mill bit 1020 and watermelon mill bit 1030 downhole on a drill string 1010. In the embodiments shown in FIG. 10, the drill string 1010, lead mill bit 1020 and watermelon mill bit 1030 drill a full window pocket 1040 in the formation. In certain embodiments, the full window pocket 1040 is between 5 m and 10 m long, and in certain other embodiments about 8.5 m long. Thereafter, a circulate and clean process could occur, and then the drill string 1010, lead mill bit 1020 and watermelon mill bit 1030 may be pulled out of hole. The lead mill bit 1020 and the watermelon mill bit 1030 may comprise one or more of the mill bits discussed in the paragraphs above. As discussed above, the lead mill bit 1020 and watermelon mill bit 1020 may be designed to remove casing 720 while moving down-hole and up-hole in a reaming process, as well as remove casing 720 when being withdrawn out of the opening.

In certain embodiments, the process for forming the full window pocket 1040 may be achieved with only one of the processes show and described with regard to FIGS. 9 and 10. For example, the full window pocket 1040 could potentially be formed only with the lead mill bit 840. In yet another embodiment, the full window pocket 1040 could potentially be formed only with the lead mill bit 1020 and the watermelon mill bit 1030. In doing so, at least one milling step may be saved.

Figure 11:
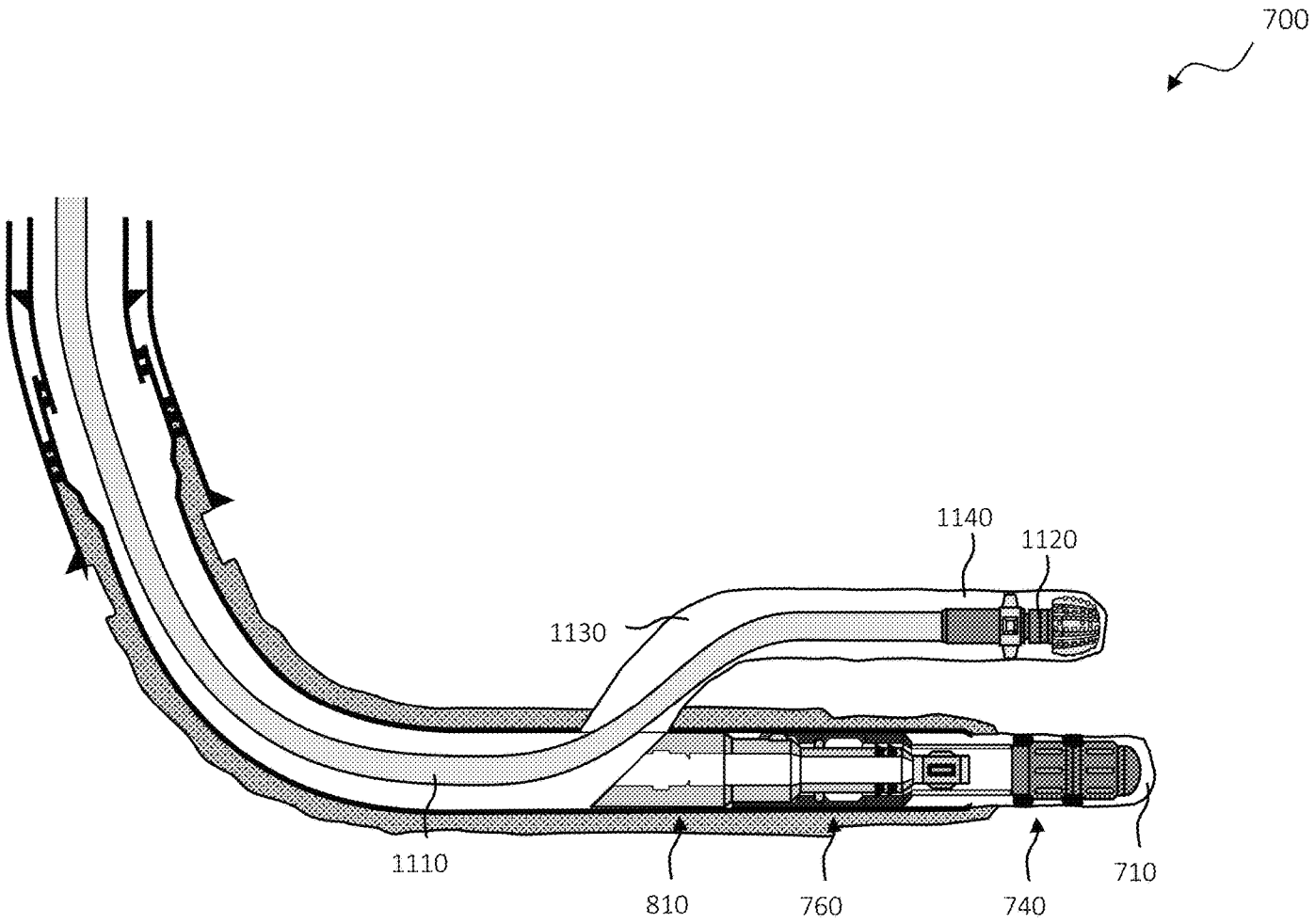

Turning to FIG. 11, illustrated is the well system 700 of FIG. 10 after running in hole a drill string 1110 with a rotary steerable assembly 1120, drilling a tangent 1130 following an inclination of the whipstock assembly 810, and then continuing to drill the lateral wellbore 1140 to depth. Thereafter, the drill string 1110 and rotary steerable assembly 1120 may be pulled out of hole.

Figure 12:
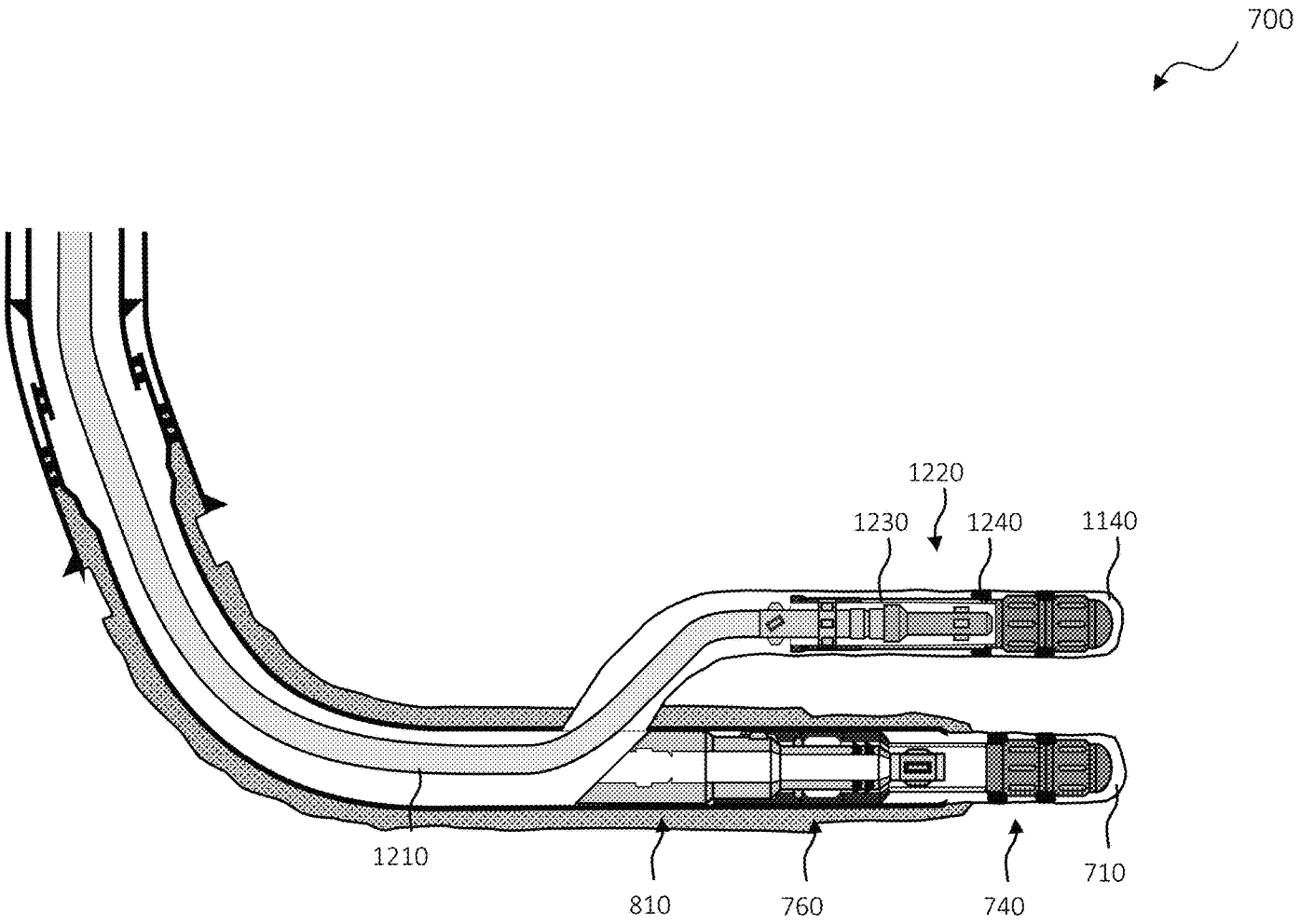

Turning to FIG. 12, illustrated is the well system 700 of FIG. 11 after employing an inner string 1210 to position a lateral wellbore completion 1220 in the lateral wellbore 1140. The lateral wellbore completion 1220 may, in certain embodiments, include a lateral wellbore liner 1230 (e.g., with frac sleeves in one embodiment), as well as one or more packers 1240 (e.g., swell packers in one embodiment). Thereafter, the inner string 1210 may be pulled into the main wellbore 710 for retrieval of the whipstock assembly 810.

Figure 13:
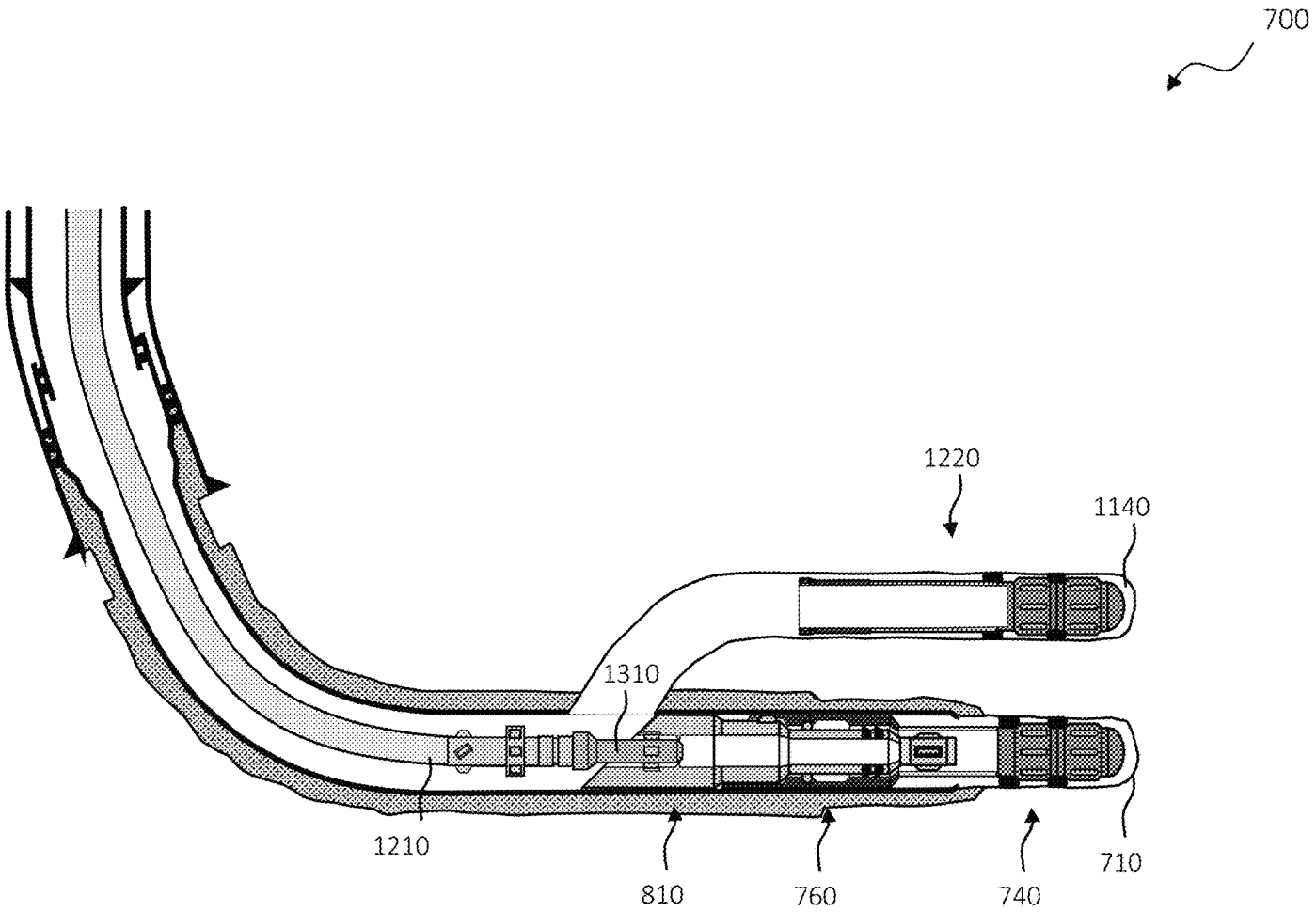

Turning to FIG. 13, illustrated is the well system 700 of FIG. 12 after latching a whipstock retrieval tool 1310 of the inner string 1210 with a profile in the whipstock assembly 810. The whipstock assembly 810 may then be pulled free from the anchor system 760, and then pulled out of hole. What results are the main wellbore completion 740 in the main wellbore 710, and the lateral wellbore completion 1220 in the lateral wellbore 1140.

Figure 14:
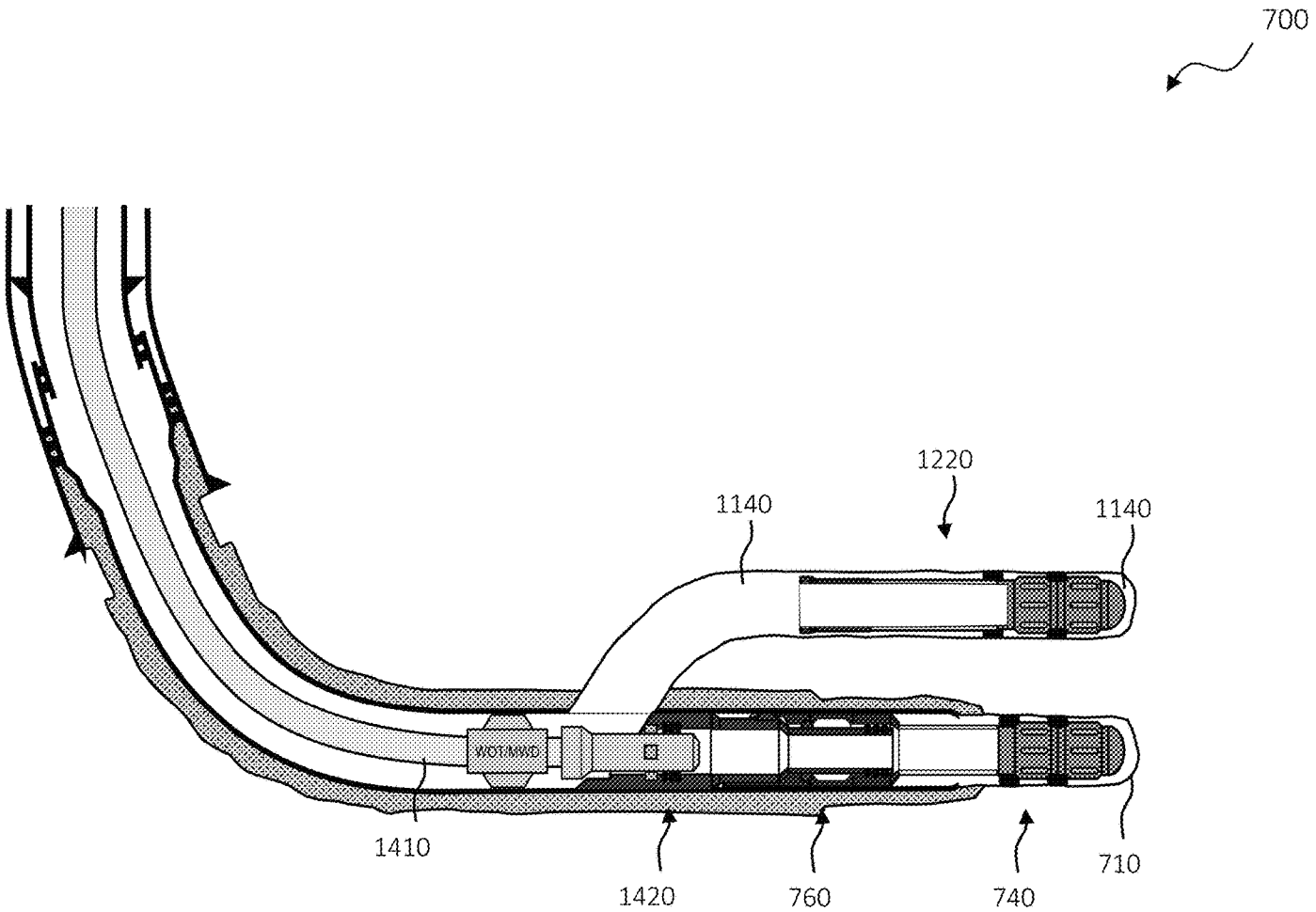

Turning to FIG. 14, illustrated is the well system 700 of FIG. 13 after employing a running tool 1410 to install a deflector assembly 1420 proximate a junction between the main wellbore 710 and the lateral wellbore 1140. The deflector assembly 1420 may be appropriately oriented using the WOT/MWD tool. The running tool 1410 may then be pulled out of hole.

Figure 15:
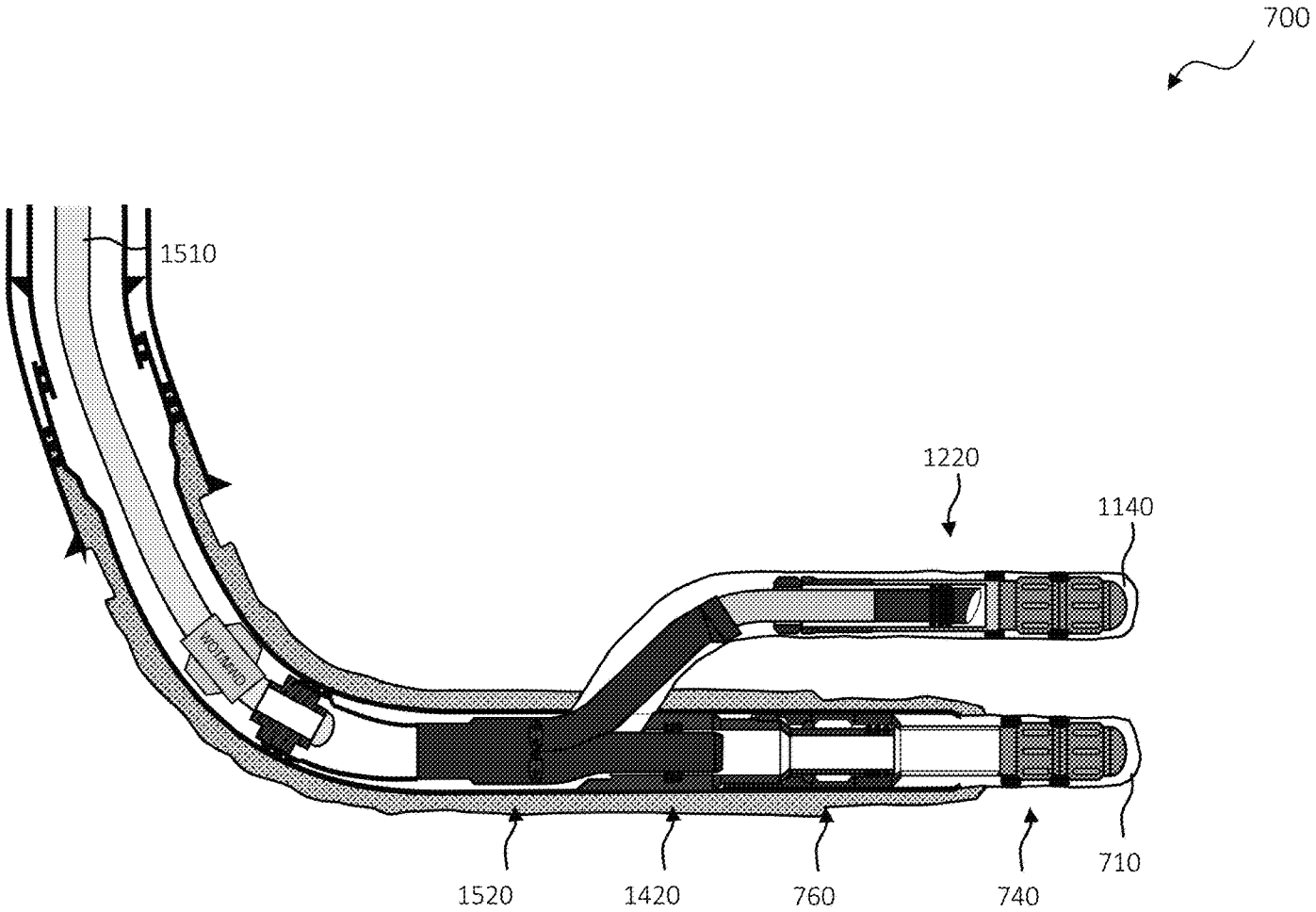

Turning to FIG. 15, illustrated is the well system 700 of FIG. 14 after employing a running tool 1510 to place a multilateral junction 1520 proximate an intersection between the main wellbore 710 and the lateral wellbore 1410.

Figure 16:
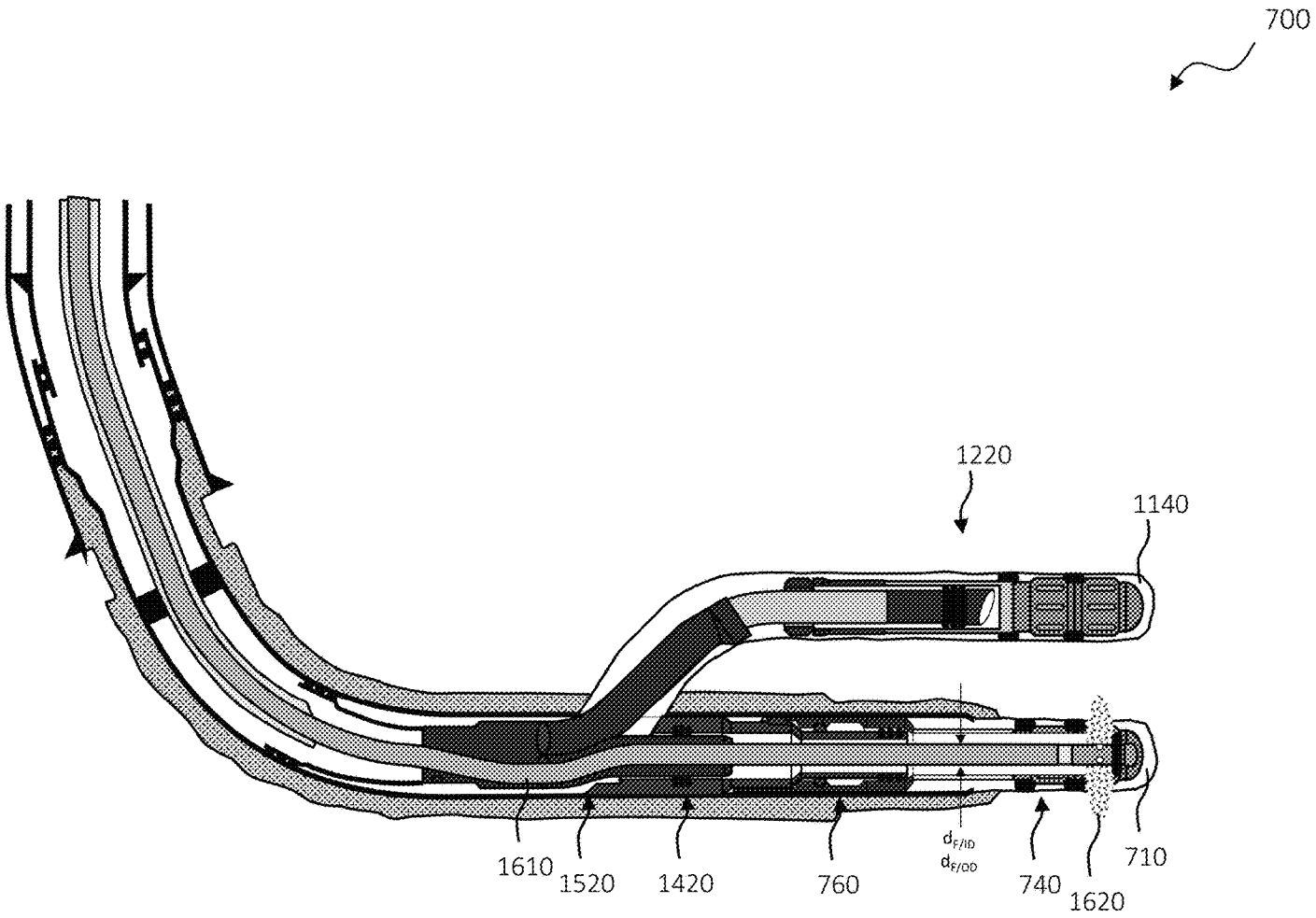

Turning to FIG. 16, illustrated is the well system 700 of FIG. 15 after selectively accessing the main wellbore 710 with a first intervention tool 1610 through the y-block of the multilateral junction 1520. With the first intervention tool 1610 in place, fractures 1620 in the subterranean formation surrounding the main wellbore completion 740 may be formed.

Figure 17:
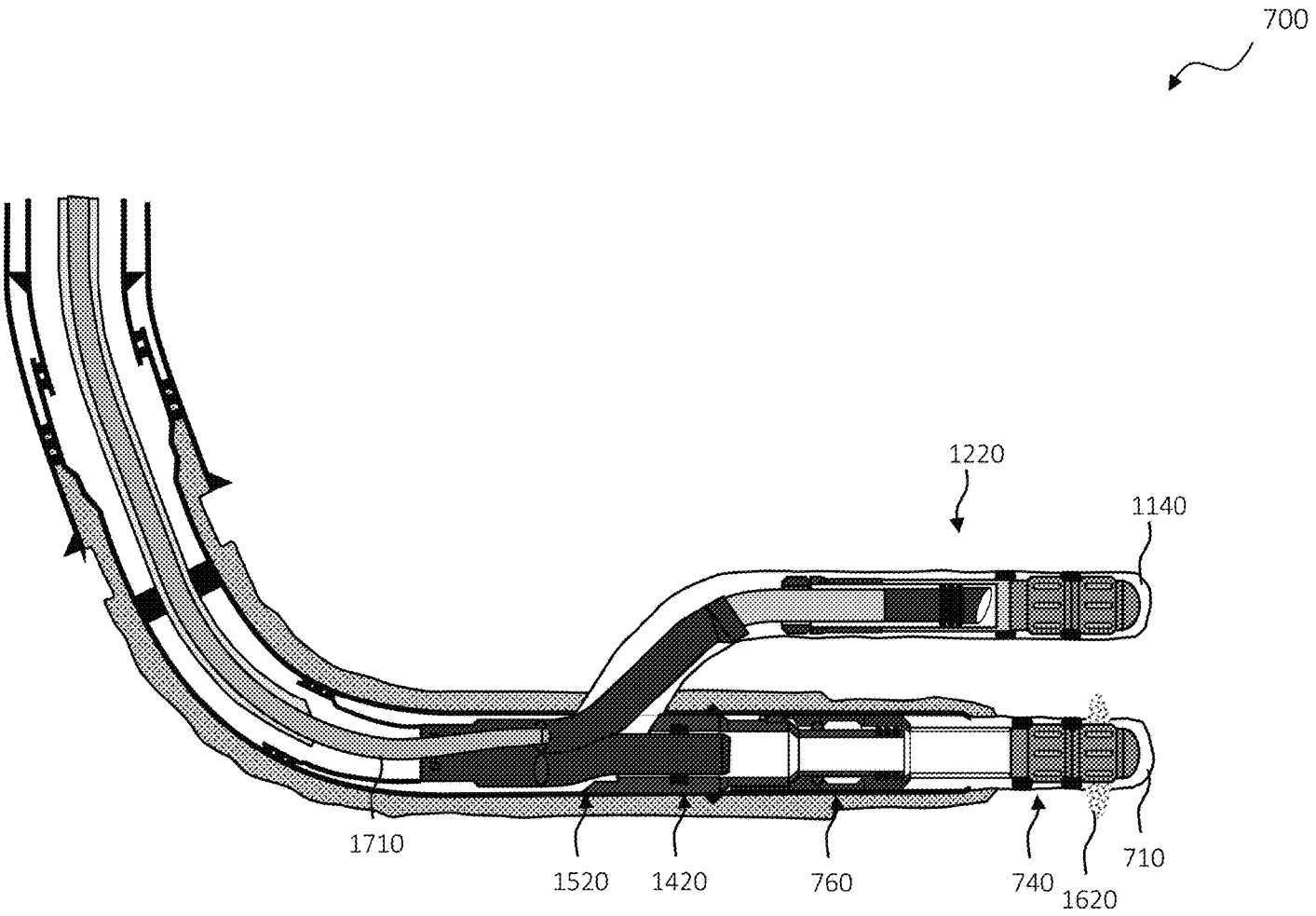

Turning to FIG. 17, illustrated is the well system 700 of FIG. 16 after positioning a second intervention tool 1710 within the multilateral junction 1520 including the y-block. In the illustrated embodiment, the second intervention tool 1710 is a second fracturing string, and more particularly a coiled tubing conveyed fracturing string.

Figure 18:
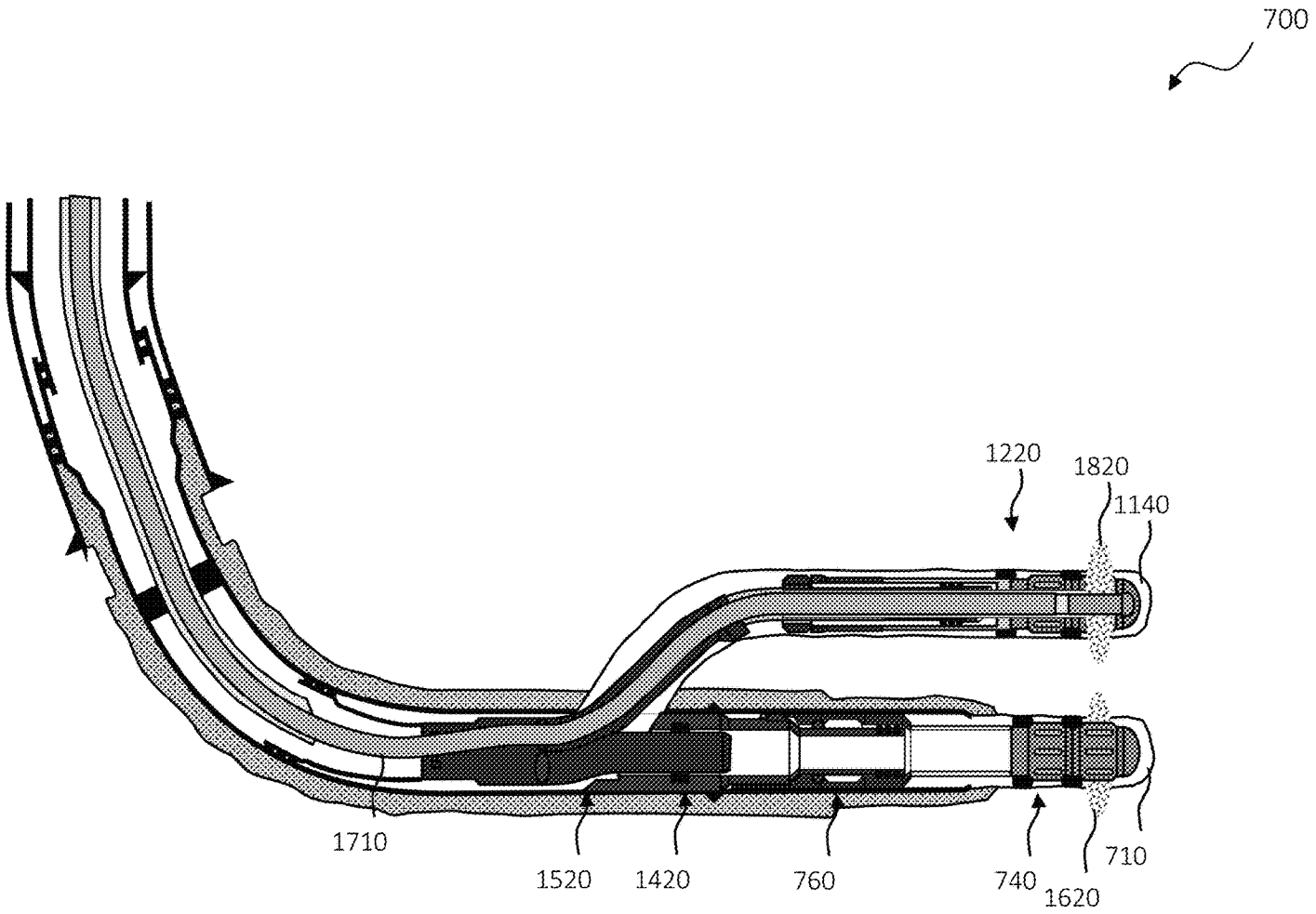

Turning to FIG. 18, illustrated is the well system 700 of FIG. 17 after putting additional weight down on the second intervention tool 1710 and causing the second intervention tool 1710 to enter the lateral wellbore 1140. With the downhole tool 1710 in place, fractures 1820 in the subterranean formation surrounding the lateral wellbore completion 1220 may be formed. In certain embodiments, the first intervention tool 1610 and the second intervention tool 1710 are the same intervention tool, and thus the same fracturing tool in one or more embodiments. Thereafter, the second intervention tool 1710 may be pulled from the lateral wellbore completion 1220 and out of the hole.

Figure 19:
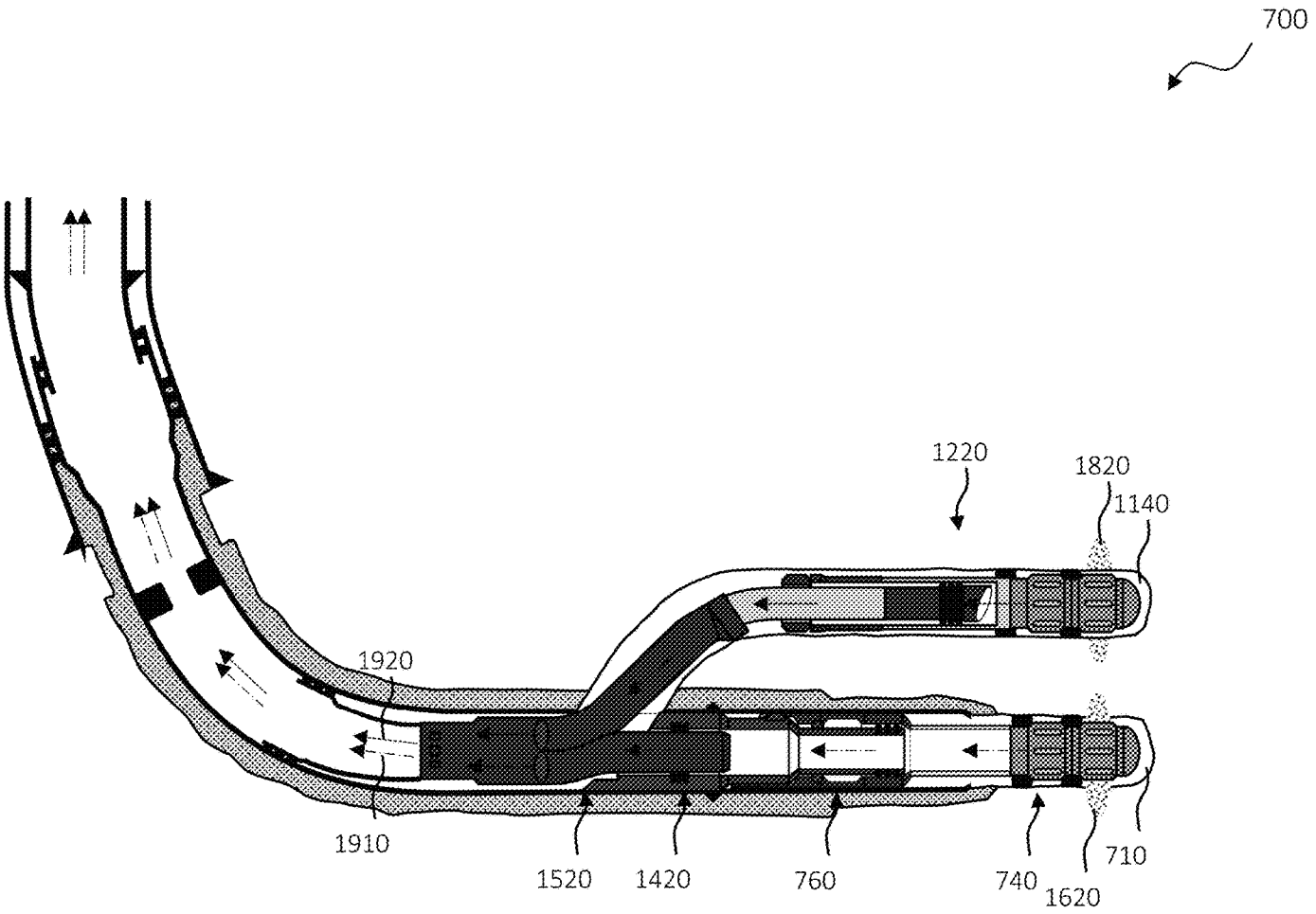

Turning to FIG. 19, illustrated is the well system 700 of FIG. 18 after producing fluids 1910 from the fractures 1620 in the main wellbore 710, and producing fluids 1920 from the fractures 1820 in the lateral wellbore 1140. The producing of the fluids 1910, 1920 occur through the multilateral junction 1520.

Aspects disclosed herein include:

A. A mill bit, the mill bit including: 1) a tubular having an uphole end and a downhole end; 2) a first cutting section having one or more first cutting surfaces disposed about the tubular, the first cutting section having a first material removal rate and configured to engage with wellbore casing disposed within a wellbore; and 3) a second cutting section having one or more second cutting surfaces disposed about the tubular, the second cutting section having a second material removal rate less than the first material removal rate and configured to engage with a whipstock disposed within the wellbore.

B. A well system, the well system including: 1) a wellbore extending through one or more subterranean formations; 2) wellbore casing located in at least a portion of the wellbore; 3) a whipstock located within the wellbore radially inside of the wellbore casing; 4) a bottom hole assembly extending within the wellbore adjacent the whipstock, the bottom hole assembly having a mill bit, the mill bit including: a) a tubular having an uphole end and a downhole end; b) a first cutting section having one or more first cutting surfaces disposed about the tubular, the first cutting section having a first material removal rate and configured to engage with wellbore casing disposed within a wellbore; and c) a second cutting section having one or more second cutting surfaces disposed about the tubular, the second cutting section having a second material removal rate less than the first material removal rate and configured to engage with a whipstock disposed within the wellbore.

C. A whipstock, the whipstock including: 1) a coupling section having a first radius of curvature, the coupling section configured to engage with a mill bit when running in hole; 2) a casing breakthrough section having a second radius of curvature; and 3) a controlled exit section having a third radius of curvature, wherein the second radius of curvature is less than the third radius of curvature.

D. A well system, the well system including: 1) a wellbore extending through one or more subterranean formations; 2) wellbore casing located in at least a portion of the wellbore; 3) a whipstock located within the wellbore radially inside of the wellbore casing, the whipstock including: a) a coupling section having a first radius of curvature, the coupling section configured to engage with a mill bit when running in hole; b) a casing breakthrough section having a second radius of curvature; and c) a controlled exit section having a third radius of curvature, wherein the second radius of curvature is less than the third radius of curvature; and a bottom hole assembly extending within the wellbore adjacent the whipstock.

Aspects A, B, C and D may have one or more of the following additional elements in combination: Element 1: wherein the one or more first cutting surfaces are positioned radially outside of the one or more second cutting surfaces. Element 2: wherein the first cutting section is a gauge section and the second cutting section is a downhole taper section located between the gauge section and the downhole end. Element 3: wherein the downhole taper section includes a first taper portion located adjacent to the gauge section and a second taper portion located more proximate the downhole end. Element 4: wherein the second taper portion has the second material removal rate. Element 5: further including a transition section having one or more transition section cutting surfaces disposed about the tubular between the second taper portion and the downhole end, the transition section having a third material removal rate less than the first material removal rate. Element 6: wherein the transition section is configured to engage with the whipstock via a shear feature when running in hole. Element 7: wherein the second material removal rate and the third material removal rate are similar material removal rates. Element 8: further including a nose section having one or more nose section cutting surfaces disposed about the tubular and positioned between the transition section and the downhole end, the nose section having a fourth material removal rate greater than the second material removal rate. Element 9: wherein the fourth material removal rate and the first material removal rate are similar material removal rates. Element 10: further including an uphole taper section having one or more uphole taper section cutting surfaces disposed about the tubular between the uphole end and the gauge section. Element 11: wherein the uphole taper section cutting surfaces are oppositely oriented to the one or more first cutting surfaces, the uphole taper section cutting surfaces configured to mill the wellbore casing when translating uphole. Element 12: wherein the uphole taper section cutting surfaces are oppositely oriented to the one or more first cutting surfaces, one or more second cutting surfaces, one or more transition section cutting surfaces, and one or more nose section cutting surfaces. Element 13: wherein a density of the one or more first cutting surfaces in the gauge section is less than a density of the one or more second cutting surfaces in the downhole taper section, for providing greater cutting pressure in the gauge section and lesser cutting pressure in the downhole taper section. Element 14: wherein rectangular carbide cutters and a tightly distributed carbide chunk backing are used in the downhole taper section and oval cutting cutters and loosely distributed carbide chunk backing are used in the gauge section. Element 15: wherein the tightly and loosely distributed carbide chunk backing comprise crushed carbide hard facing. Element 16: wherein the gauge section includes only a single Polycrystalline Diamond Compact (PDC) cutter whereas the downhole taper section includes two or more Polycrystalline Diamond Compact (PDC) cutters. Element 17: further including a nose section having one or more nose section cutting surfaces disposed about the tubular and positioned between the downhole taper section and the downhole end, the nose section having three or more Polycrystalline Diamond Compact (PDC) cutters. Element 18: further including a nose section having one or more nose section cutting surfaces disposed about the tubular and positioned between the downhole taper section and the downhole end, the nose section having three or more Polycrystalline Diamond Compact (PDC) cutters and three or more Tungsten Carbide Insert (TCI) cutters, and further wherein the three or more Tungsten Carbide Insert (TCI) cutters are radially outside of the three or more Polycrystalline Diamond Compact (PDC) cutters. Element 19: wherein the three or more Tungsten Carbide Insert (TCI) cutters are radially outside of the three or more Polycrystalline Diamond Compact (PDC) cutters by a distance of at least 1.27 mm. Element 20: further including one or more Polycrystalline Diamond Compact (PDC) cutters located at an uphole end of the gauge section, the one or more Polycrystalline Diamond Compact (PDC) cutters having a 0° relief and radial rake angle. Element 21: further including one or more oppositely oriented cutting surfaces disposed about the tubular, the one or more oppositely oriented cutting surfaces oppositely oriented to the one or more first cutting surfaces, the one or more oppositely oriented cutting surfaces configured to mill the wellbore casing when translating uphole. Element 21: further including one or more Polycrystalline Diamond Compact (PDC) cutters located at an uphole end of the gauge section, the one or more Polycrystalline Diamond Compact (PDC) cutters having a 0° relief and radial rake angle. Element 22: further including one or more oppositely oriented cutting surfaces disposed about the tubular, the one or more oppositely oriented cutting surfaces oppositely oriented to the one or more first cutting surfaces, the one or more oppositely oriented cutting surfaces configured to mill the wellbore casing when translating uphole. Element 23: further including a watermelon mill bit coupled to the uphole end. Element 24: further including a lateral wellbore extending from the wellbore proximate the whipstock. Element 25: wherein the whipstock includes: a coupling section having a first radius of curvature, the coupling section configured to engage with the mill bit when running in hole; a casing breakthrough section having a second radius of curvature; and a controlled exit section having a third radius of curvature, wherein the second radius of curvature is less than the third radius of curvature. Element 26: wherein the second radius of curvature is at least 5% less than the third radius of curvature. Element 27: wherein the second radius of curvature is at least 10% less than the third radius of curvature. Element 28: wherein the second radius of curvature is at least 25% less than the third radius of curvature. Element 29: wherein the second radius of curvature is less than the first radius of curvature. Element 30: wherein the third radius of curvature is less than the first radius of curvature. Element 31: wherein the coupling section has a first ramp rate, the casing breakthrough section has a second ramp rate, and the controlled exit section has a third ramp rate. Element 32: wherein the first ramp rate is less than the second ramp rate but greater than the third ramp rate. Element 33: wherein the second ramp rate is at least six times the first ramp rate. Element 34: wherein the controlled exit section includes a downhole portion with a downhole portion ramp rate and an uphole portion with an uphole portion ramp rate, and further wherein a downhole portion ramp rate is less than an uphole portion ramp rate.

Those skilled in the art to which this application relates will appreciate that other and further additions, deletions, substitutions, and modifications may be made to the described embodiments.

What is claimed is:

1. A mill bit, comprising:

a tubular having an uphole end and a downhole end;

a first cutting section having one or more first cutting surfaces disposed about the tubular, the first cutting section having a first material removal rate and configured to engage with wellbore casing disposed within a wellbore; and a second cutting section having one or more second cutting surfaces disposed about the tubular, the second cutting section having a second material removal rate less than the first material removal rate and configured to engage with a whipstock disposed within the wellbore at a similar time as the first cutting section is engaged with the wellbore casing.

2. The mill bit as recited in claim 1, wherein the one or more first cutting surfaces are positioned radially outside of the one or more second cutting surfaces.

3. The mill bit as recited in claim 1, wherein the first cutting section is a gauge section and the second cutting section is a downhole taper section located between the gauge section and the downhole end.

4. The mill bit as recited in claim 3, wherein the downhole taper section includes a first taper portion located adjacent to the gauge section and a second taper portion located more proximate the downhole end.

5. The mill bit as recited in claim 4, wherein the second taper portion has the second material removal rate.

6. The mill bit as recited in claim 5, further including a transition section having one or more transition section cutting surfaces disposed about the tubular between the second taper portion and the downhole end, the transition section having a third material removal rate less than the first material removal rate.

7. The mill bit as recited in claim 6, wherein the transition section is configured to engage with the whipstock via a shear feature when running in hole.

8. The mill bit as recited in claim 6, wherein the second material removal rate and the third material removal rate are similar material removal rates.

9. The mill bit as recited in claim 6, further including a nose section having one or more nose section cutting surfaces disposed about the tubular and positioned between the transition section and the downhole end, the nose section having a fourth material removal rate greater than the second material removal rate.

10. The mill bit as recited in claim 9, wherein the fourth material removal rate and the first material removal rate are similar material removal rates.

11. The mill bit as recited in claim 9, further including an uphole taper section having one or more uphole taper section cutting surfaces disposed about the tubular between the uphole end and the gauge section.

12. The mill bit as recited in claim 11, wherein the uphole taper section cutting surfaces are oppositely oriented to the one or more first cutting surfaces, the uphole taper section cutting surfaces configured to mill the wellbore casing when translating uphole.

13. The mill bit as recited in claim 11, wherein the uphole taper section cutting surfaces are oppositely oriented to the one or more first cutting surfaces, one or more second cutting surfaces, one or more transition section cutting surfaces, and one or more nose section cutting surfaces.

14. The mill bit as recited in claim 3, wherein a density of the one or more first cutting surfaces in the gauge section is less than a density of the one or more second cutting surfaces in the downhole taper section, for providing greater cutting pressure in the gauge section and lesser cutting pressure in the downhole taper section.

15. The mill bit as recited in claim 14, wherein rectangular carbide cutters and a tightly distributed carbide chunk backing are used in the downhole taper section and oval cutting cutters and loosely distributed carbide chunk backing are used in the gauge section.

16. The mill bit as recited in claim 15, wherein the tightly and loosely distributed carbide chunk backing comprise crushed carbide hard facing.

17. The mill bit as recited in claim 3, wherein the gauge section includes only a single Polycrystalline Diamond Compact (PDC) cutter whereas the downhole taper section includes two or more Polycrystalline Diamond Compact (PDC) cutters.

18. The mill bit as recited in claim 17, further including a nose section having one or more nose section cutting surfaces disposed about the tubular and positioned between the downhole taper section and the downhole end, the nose section having three or more Polycrystalline Diamond Compact (PDC) cutters.

19. The mill bit as recited in claim 3, further including a nose section having one or more nose section cutting surfaces disposed about the tubular and positioned between the downhole taper section and the downhole end, the nose section having three or more Polycrystalline Diamond Compact (PDC) cutters and three or more Tungsten Carbide Insert (TCI) cutters, and further wherein the three or more Tungsten Carbide Insert (TCI) cutters are radially outside of the three or more Polycrystalline Diamond Compact (PDC) cutters.

20. The mill bit as recited in claim 19, wherein the three or more Tungsten Carbide Insert (TCI) cutters are radially outside of the three or more Polycrystalline Diamond Compact (PDC) cutters by a distance of at least 1.27 mm.

21. The mill bit as recited in claim 3, further including one or more Polycrystalline Diamond Compact (PDC) cutters located at an uphole end of the gauge section, the one or more Polycrystalline Diamond Compact (PDC) cutters having a 0° relief and radial rake angle.

22. The mill bit as recited in claim 1, further including one or more oppositely oriented cutting surfaces disposed about the tubular, the one or more oppositely oriented cutting surfaces oppositely oriented to the one or more first cutting surfaces, the one or more oppositely oriented cutting surfaces configured to mill the wellbore casing when translating uphole.

23. A well system, comprising:

a wellbore extending through one or more subterranean formations;

wellbore casing located in at least a portion of the wellbore;

a whipstock located within the wellbore radially inside of the wellbore casing;

a bottom hole assembly extending within the wellbore adjacent the whipstock, the bottom hole assembly having a mill bit, the mill bit including:

a tubular having an uphole end and a downhole end;

a first cutting section having one or more first cutting surfaces disposed about the tubular, the first cutting section having a first material removal rate and configured to engage with wellbore casing disposed within a wellbore at a similar time as the first cutting section is engaged with the wellbore casing; and a second cutting section having one or more second cutting surfaces disposed about the tubular, the second cutting section having a second material removal rate less than the first material removal rate and configured to engage with a whipstock disposed within the wellbore.

24. The well system as recited in claim 23, wherein the one or more first cutting surfaces are positioned radially outside of the one or more second cutting surfaces.

25. The well system as recited in claim 23, wherein the first cutting section is a gauge section and the second cutting section is a downhole taper section located between the gauge section and the downhole end.

26. The well system as recited in claim 25, wherein the downhole taper section includes a first taper portion located adjacent to the gauge section and a second taper portion located more proximate the downhole end.

27. The well system as recited in claim 26, wherein the second taper portion has the second material removal rate.

28. The well system as recited in claim 27, further including a transition section having one or more transition section cutting surfaces disposed about the tubular between the second taper portion and the downhole end, the transition section having a third material removal rate less than the first material removal rate.

29. The well system as recited in claim 28, wherein the transition section is coupled with the whipstock via a shear feature.

30. The well system as recited in claim 28, wherein the second material removal rate and the third material removal rate are similar material removal rates.

31. The well system as recited in claim 28, further including a nose section having one or more nose section cutting surfaces disposed about the tubular and positioned between the transition section and the downhole end, the nose section having a fourth material removal rate greater than the second material removal rate.

32. The well system as recited in claim 31, wherein the fourth material removal rate and the first material removal rate are similar material removal rates.

33. The well system as recited in claim 31, further including an uphole taper section having one or more uphole taper section cutting surfaces disposed about the tubular between the uphole end and the gauge section.

34. The well system as recited in claim 33, wherein the uphole taper section cutting surfaces are oppositely oriented to the one or more first cutting surfaces, the uphole taper section cutting surfaces configured to mill the wellbore casing when translating uphole.

35. The well system as recited in claim 33, wherein the uphole taper section cutting surfaces are oppositely oriented to the one or more first cutting surfaces, one or more second cutting surfaces, one or more transition section cutting surfaces, and one or more nose section cutting surfaces.

36. The well system as recited in claim 25, wherein a density of the one or more first cutting surfaces in the gauge section is less than a density of the one or more second cutting surfaces in the downhole taper section, for providing greater cutting pressure in the gauge section and lesser cutting pressure in the downhole taper section.

37. The well system as recited in claim 36, wherein rectangular carbide cutters and a tightly distributed carbide chunk backing are used in the downhole taper section and oval cutting cutters and loosely distributed carbide chunk backing are used in the gauge section.

38. The well system as recited in claim 37, wherein the tightly and loosely distributed carbide chunk backing comprise crushed carbide hard facing.

39. The well system as recited in claim 25, wherein the gauge section includes only a single Polycrystalline Diamond Compact (PDC) cutter whereas the downhole taper section includes two or more Polycrystalline Diamond Compact (PDC) cutters.

40. The well system as recited in claim 39, further including a nose section having one or more nose section cutting surfaces disposed about the tubular and positioned between the downhole taper section and the downhole end, the nose section having three or more Polycrystalline Diamond Compact (PDC) cutters.

41. The well system as recited in claim 25, further including a nose section having one or more nose section cutting surfaces disposed about the tubular and positioned between the downhole taper section and the downhole end, the nose section having three or more Polycrystalline Diamond Compact (PDC) cutters and three or more Tungsten Carbide Insert (TCI) cutters, and further wherein the three or more Tungsten Carbide Insert (TCI) cutters are radially outside of the three or more Polycrystalline Diamond Compact (PDC) cutters.

42. The well system as recited in claim 25, further including one or more Polycrystalline Diamond Compact (PDC) cutters located at an uphole end of the gauge section, the one or more Polycrystalline Diamond Compact (PDC) cutters having a 0° relief and radial rake angle.

43. The well system as recited in claim 23, further including one or more oppositely oriented cutting surfaces disposed about the tubular, the one or more oppositely oriented cutting surfaces oppositely oriented to the one or more first cutting surfaces, the one or more oppositely oriented cutting surfaces configured to mill the wellbore casing when translating uphole.

44. The well system as recited in claim 23, further including a watermelon mill bit coupled to the uphole end.

45. The well system as recited in claim 23, further including a lateral wellbore extending from the wellbore proximate the whipstock.

46. The well system as recited in claim 23, wherein the whipstock includes:

a coupling section having a first radius of curvature, the coupling section configured to engage with the mill bit when running in hole;

a casing breakthrough section having a second radius of curvature; and a controlled exit section having a third radius of curvature, wherein the second radius of curvature is less than the third radius of curvature.

* * * * *